US011180898B2

(12) United States Patent
Ness

(10) Patent No.: US 11,180,898 B2
(45) Date of Patent: Nov. 23, 2021

(54) BLOCK WITH CURVED ENGAGEMENT SURFACES FOR MAINTAINING EVEN SETBACK

(71) Applicant: Ness Inventions, Inc., St. Paul, MN (US)

(72) Inventor: Jeffrey Ness, St. Paul, MN (US)

(73) Assignee: Ness Inventions, Inc., St. Paul, MN (US)

( * ) Notice: Subject to any disclaimer, the term of this patent is extended or adjusted under 35 U.S.C. 154(b) by 0 days.

(21) Appl. No.: 16/872,134

(22) Filed: May 11, 2020

(65) Prior Publication Data

US 2021/0010220 A1 Jan. 14, 2021

Related U.S. Application Data

(60) Provisional application No. 62/846,095, filed on May 10, 2019.

(51) Int. Cl.
*E02D 29/02* (2006.01)
*E04C 1/39* (2006.01)

(52) U.S. Cl.
CPC ..... *E02D 29/025* (2013.01); *E04C 1/395* (2013.01)

(58) Field of Classification Search
CPC .. E02D 29/025; E04C 1/395; E04B 2002/026
See application file for complete search history.

(56) References Cited

U.S. PATENT DOCUMENTS

| | | | | |
|---|---|---|---|---|
| 1,334,599 | A | 3/1920 | Cusick | |
| 2,313,363 | A | 7/1940 | Schmitt | |
| 5,353,569 | A | 10/1994 | Rodrique | |
| 5,709,062 | A * | 1/1998 | Woolford | B28B 7/42 52/604 |
| 6,019,550 | A | 2/2000 | Wrigley et al. | |
| 6,523,317 | B1 | 2/2003 | Bott et al. | |
| 6,877,290 | B2 | 4/2005 | Mason | |
| 7,351,014 | B2 | 4/2008 | Price et al. | |
| 8,136,325 | B1 | 3/2012 | Van Lerberg et al. | |
| 2002/0054790 | A1* | 5/2002 | Price | E02D 29/025 405/284 |
| 2004/0065042 | A1* | 4/2004 | Gresser | B28B 7/0044 52/604 |
| 2008/0244995 | A1* | 10/2008 | Kemp | E02D 29/025 52/169.4 |
| 2013/0315678 | A1* | 11/2013 | Karau | E04B 2/36 405/284 |

* cited by examiner

*Primary Examiner* — Carib A Oquendo
(74) *Attorney, Agent, or Firm* — Dicke, Billig & Czaja PLLC

(57) ABSTRACT

A retaining wall block including a pair of curved engagement surfaces extending convexly from a rear side of the block and being symmetrical about a transverse axis are configured to engage a planar surface of a setback lip of similar overlying blocks when stacked in successive courses to form a wall structure, where the curved engagement surfaces maintain a desired setback distance successive courses for straight, convex, and concave wall structures.

5 Claims, 33 Drawing Sheets

BLOCK WITH CURVED ENGAGEMENT SURFACES FOR MAINTAINING EVEN SETBACK

BACKGROUND OF THE INVENTION

Retaining wall blocks typically include a setback lip or flange which normally extends from the bottom face of the block along a back edge formed with a rear face of the block. When the blocks are stacked in courses to form a wall or other structure, the setback lip of a block of butts against the rear face of one or more block(s) of the next lower course of blocks to create a setback between the front faces of the blocks such that each successive course of blocks is stepped back from the previous (lower) course of blocks, such as by a thickness of the lip, for example. The lip interlocks each course of blocks the preceding course of blocks, where the interlocking of the blocks and the stepping back of each successive course strengthens the wall structure, such as when the wall is retaining soil, for example.

DETAILED DESCRIPTION

Figure 1A:
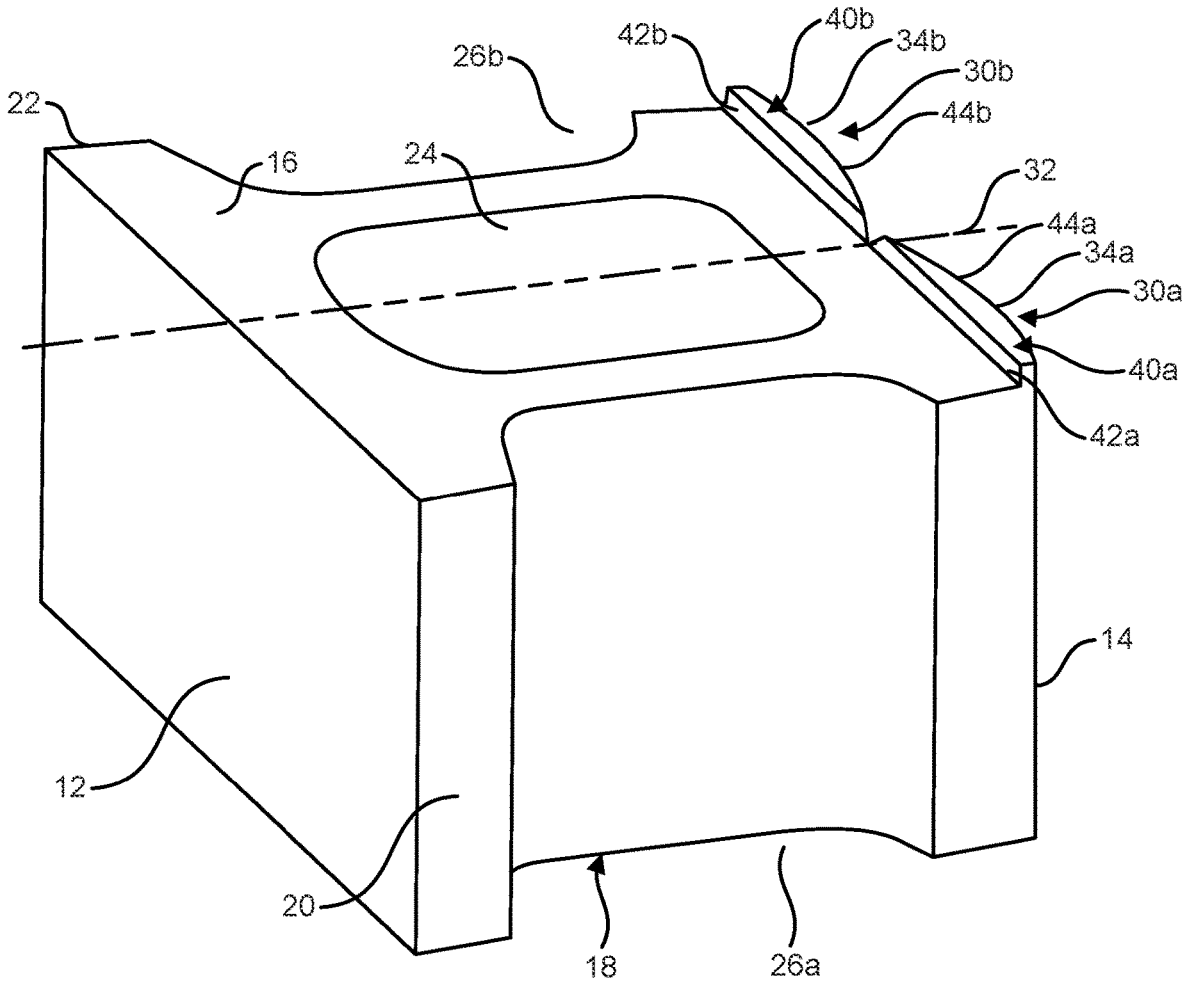
FIGS. 1A to 1G generally illustrate a perspective, bottom, top, first side, second side, front, and rear views of a retaining wall block, according to one example.

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of different implementations of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Retaining wall blocks typically include a setback lip or flange which normally extends from the bottom face of the block along a back edge formed with a rear face of the block. Such setback lips may sometimes simply be referred to as "rear lips". When the blocks are stacked in courses to form a wall or other structure, the rear lip butts against the rear face of one or more block(s) of the next lower course of blocks to create a setback between the front faces of the blocks such that each successive course of blocks is stepped back from the previous (lower) course of blocks, such as by a thickness (i.e., a depth) of the lip, for example. The lip interlocks each course of blocks the preceding course of blocks, where the interlocking of the blocks and the stepping back of each successive course strengthens the wall structure, such as when the wall is retaining soil, for example.

While setback lips provide a simple and effective means for aligning blocks and for strengthening wall structures via interlocking and creating a setback between successive block courses, when retaining wall blocks are arranged to form curved walls (both convex and concave), a setback distance between wall courses along the curved portions of the wall varies between block courses and between blocks of a same course relative to a uniform setback distance on straight portions of the wall. Such non-uniformity may give the wall an uneven appearance, which can sometimes be undesirable, and may even lessen the strength of the wall structure.

Also, as each successive course of blocks is added to a wall structure, an overall depth of the wall structure increases, with the greater the setback distance of a given block being employed, the greater the depth which is added to the overall wall depth by each block course. In cases where horizontal space is limited, the setback distance created by the rear lip may prevent such block from being employed to form a retaining wall.

As will be described in greater detail herein, the present disclosure provides a retaining wall block having a rear face comprising a pair of convex curved engagement surfaces that are symmetrical (i.e., mirror images) about a transverse centerline of the block (between a front face and the rear face) such that one of the curved engagement surfaces is disposed between the transverse centerline and a first side face of the block, and the other of the curved engagement surfaces is disposed between the transverse centerline and an opposing second side face of the block. The pair of convex curved engagement surfaces may be referred to herein as first and second engagement surfaces.

In examples, the block includes a rear lip extending from the bottom face of the block along an edge formed by the bottom and rear faces, wherein a front side of the lip facing the front face of the block comprises a planar surface, and an opposing rear side of the lip forms a portion of the rear face of the block. In one example, the rear lip may have a single, continuous planar front side, where the rear side of the lip forms a portion of the pair of convex engagement surfaces. In some examples, the rear lip comprises a pair of lips laterally spaced from one another, with each lip corresponding to different one of the first and second curved engagement surfaces. Such a lip arrangement is sometimes referred to herein as a "split lip" configuration.

When stacked in successive courses to form a wall, each retaining wall block is pulled forward such that the curved engagement surfaces of one or more blocks in the immediately underlying block course engage the planar front side of the lip. In one example, a desired setback distance between the front faces of blocks of successive courses is defined by a thickness of the lip at its deepest point between the front side of the lip and an apex of the curved engagement surfaces. In other examples, as will be described in greater detail below, the retaining wall block may contain a notch in the top face along an edge of the block formed by top and rear faces, where the notch is configured to receive at least a portion of the lip, such that the desired setback distance between the front faces of blocks of successive courses is defined by the thickness of the lip and the depth of the notch in a direction parallel to the transverse centerline. In one example, a surface of the notch facing the rear face of the block includes the first and second curved engagement surfaces.

In one example, when the block courses are stacked in a running bond configuration where a transverse centerline of a retaining wall block of an upper block course is aligned with a joint where a pair of adjacent blocks in the underlying block course abut one another, the lip is engaged by one curved engagement surface of each of the underlying pair of adjacent blocks. As will be described in greater detail below, when stacked to form a straight wall, the lip is engaged by an apex of the underlying curved engagement surfaces such that the front faces of the blocks of successive courses are offset the desired offset distance. Furthermore, in accordance with the teaching of the present disclosure, which will be described in greater detail below, when the retaining wall blocks are stacked to form both and convex and concave walls, the slope of the first and second convex engagement surfaces is configured such that different portions of the first and second engagement surfaces engage the planar front side of the lip(s) of an overlying block for different angles of curvature of the retaining wall such that the desired offset distance is maintained between successive courses of blocks for both convex and concave structures (in contrast to known retaining wall blocks where the offset distances change when the blocks are arranged to form convex and concave wall structures).

In one example, as will be described in greater detail below, each of the convex curved engagement surfaces comprises a spline curve formed by fitting a curve to a number of points determined via a block modeling process carried out over a range of different angles of curvature for both convex and concave wall structures (e.g., −20 to +20 degrees of curvature). It is noted that the spline curve is uniquely modeled for blocks having different dimensions (e.g., width and depth). Such a modeled spline curve precisely maintains a constant setback distance over the range of angles of curvatures, but also represents the most costly and difficult implementation for forming the retaining wall block (e.g., machining a concrete block mold to match the spline curve and stripping a block from such mold form).

In one example, each curved engagement surface comprise an arc segment having a radius selected to approximate the modeled spline curve. In one example, each curved engagement surface comprises and arc segment having radius equal to a depth of the block, where the center point of the radius for each engagement surface is positioned on the corresponding ¼-point of the block. In one example, as illustrated in greater detail below, each curved engagement surface comprises a series of line segments selected to approximate the modeled spline curve. In one example, as will be illustrated in greater detail below, each curved engagement surface comprises a series of three curve segments. In other examples, more or fewer than three line segments may be employed.

FIGS. 1A-1G respectively illustrate perspective, bottom side, top side, first side, second side, front side, and rear side views of a retaining wall block 10, according to one example of the present disclosure. Block 10 includes a front side 12 and an opposing rear side 14, a bottom side 16 and an opposing top side 18, and a first side 20 and an opposing second side 22. In one example, block 10 includes a hollow core 24 extending there through between bottom side 16 and top side 18, and further includes recesses 26*a* and 26*b* in first and second sides 20 and 22, when recesses 26*a* and 26*b* are arranged to align with a hollow core of a block and an underlying course of blocks and when blocks 10 are arranged in successive courses in a running bond pattern (e.g., see FIG. 2B) to form a wall structure.

In one example, first and second sides are inwardly angled from front side 12 to rear side 14 at an angle, $\theta_S$, such that a width, $w_F$, of front side 12 is greater than a width, $w_R$, of rear side 14. In one example, the side angle, $\theta_S$, is 10-degrees, although any number of suitable side angles may be employed. As illustrated below, side angle, $\theta_S$, enables convex wall structures to be formed with angles of curvature up to two times side angle, $\theta_S$, without requiring modification of the block (e.g., cutting). For example, if side angle, $\theta_S$, is 10-degrees, a convex wall structure having an angle of curvature of up to 20-degrees from horizontal may be formed without the need to modify block 10 (see FIG. 2C, for example).

In accordance with the present disclosure, block 10 includes first and second convexly curved engagement surfaces 30*a* and 30*b* extending from rear side 14 which are symmetrical (i.e., mirror images) about a transverse centerline 32 of block 10. In one example, curved engagement surfaces 30*a* and 30*b* have respectively apexes 34*a* and 34*b*, such that a depth, D, of block 10 increases as one moves along inner portions 36*a* and 36*b* of curved engagement surfaces 30*a* and 30*b* in a direction from transverse centerline 32 toward first and second sides 20 and 22 until reaching respective apexes 34*a* and 34*b*, and then decreases along outer portions 38*a* and 38*b* of curved engagement surfaces 30*a* and 30*b* as one moves from apexes 34*a* and 34*b* toward respective first and second sides 20 and 22. In one example, as illustrated, curved engagement surfaces 30*a* and 30*b* are spline curves fitted to control points determined from a modeling process (which will be described in greater detail below). In one example, curved engagement surfaces extend along the entire rear side 14 of block 10 between bottom and top sides 16 and 18.

In one example, as illustrated, block 10 includes a pair of setback lips 40*a* and 40*b* extending from bottom side 16 along and edge of block 10 formed by rear side 15 and bottom side 16. In one example, setback lips 40*a* and 40*b* include respective planar front surfaces 42*a* and 42*b*, and respective rear surfaces 44*a* and 44*b* comprising extensions of corresponding curved engagement surfaces 30*a* and 30*b*. In one example, setback lips 40*a* and 40*b* have a depth, $d_L$, as measured from front side 12 to rear side 14 at apexes 34*a* and 34*b*, and extend a distance (height), $h_L$, from bottom side 16. In one example, as illustrated by block 10 of FIGS. 1A to 1G, depth, $d_L$, of setback lips 40*a* and 40*b* defines a desired setback distance, $d_S$, between front sides 12 of blocks 10 of successive courses when stacked to form a wall structure with curved engagement surfaces 30*a* and 30*b* of a lower block course engaging the planar front surfaces 42*a* and 42*b* of setback lips 40*a* and 40*b* (see FIG. 2A, for example).

As will be described in greater detail below (see FIGS. 2A-2D, for example), when blocks 10 are stacked in a number of successive courses to form a wall structure with a running bond pattern (where side edges of blocks of a given course align with midpoints of blocks of block courses immediately above and below the given course), first and second convexly curved engagement surfaces 30*a* and 30*b* have changing slopes over respective inner curve portions 36*a*/36*b* and over respective outer curve portions 38*a*/38*b* such that the desired setback distance, $d_S$, between blocks 10 of successive rows is maintained for both convex wall structures (see FIG. 2C) and concave wall structures (see FIG. 2D), as well as for straight wall structures.

Figure 1B:
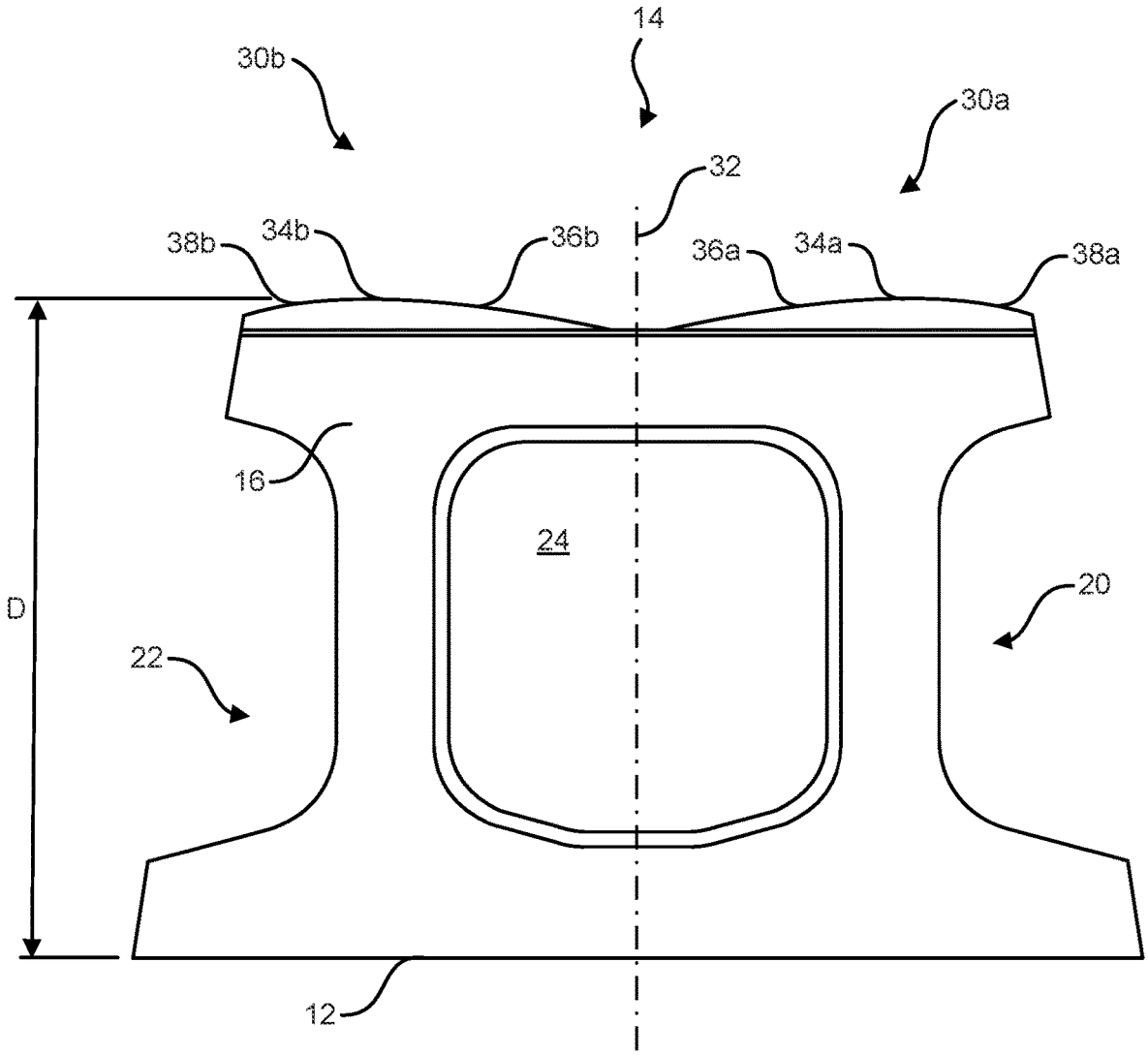
Figure 1C:
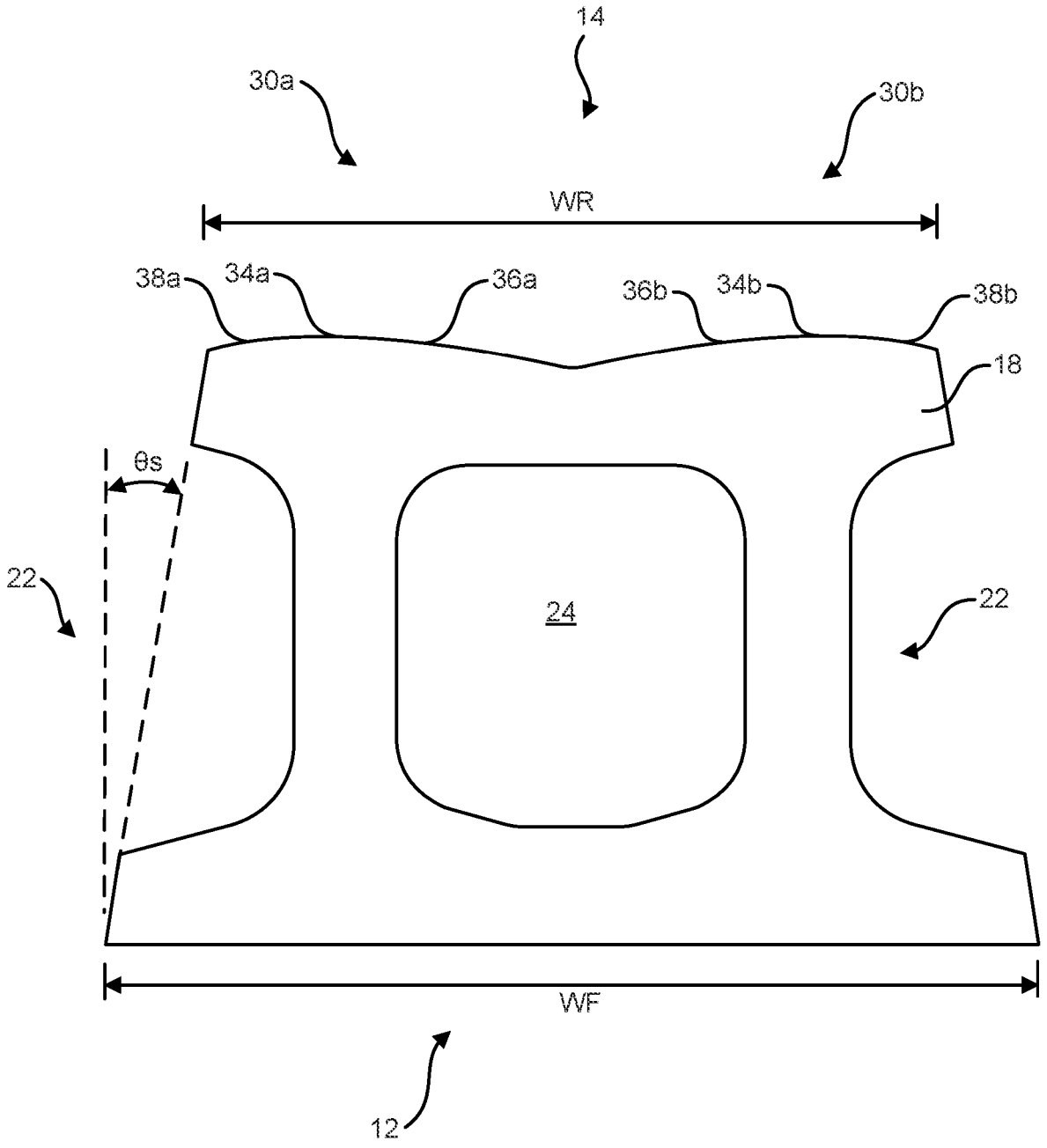
Figure 1D:
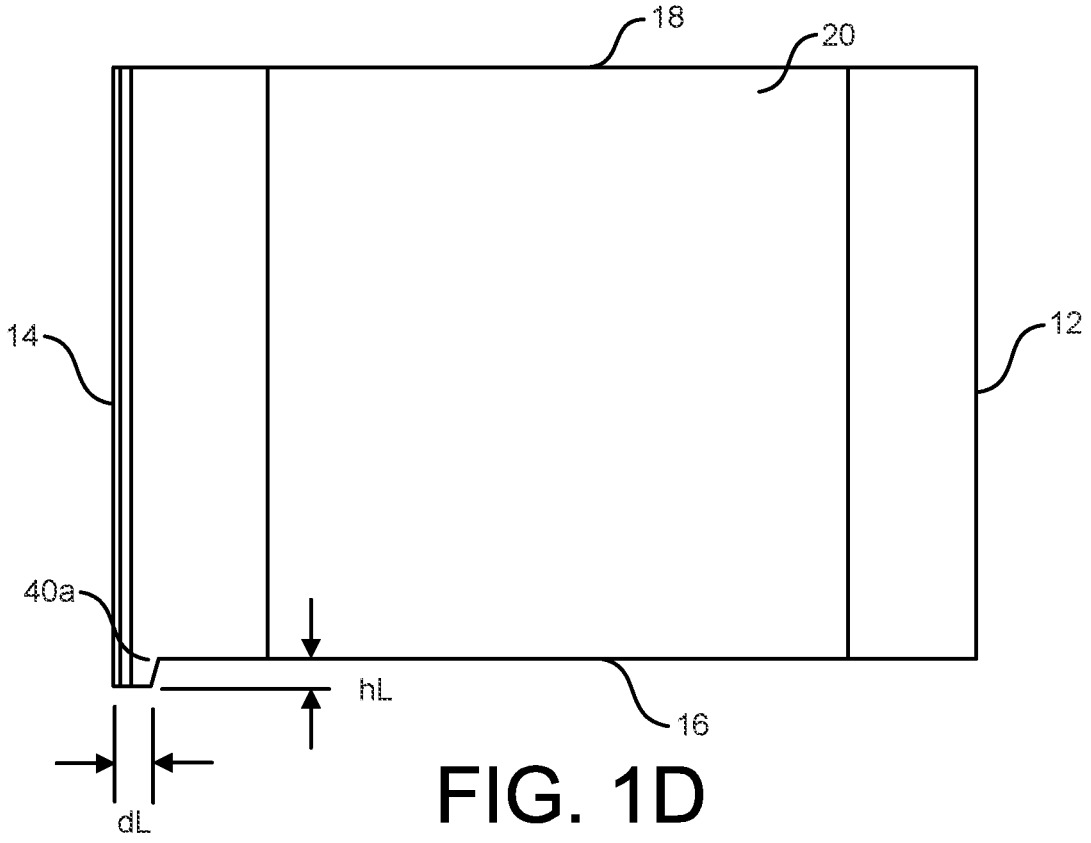
Figure 1E:
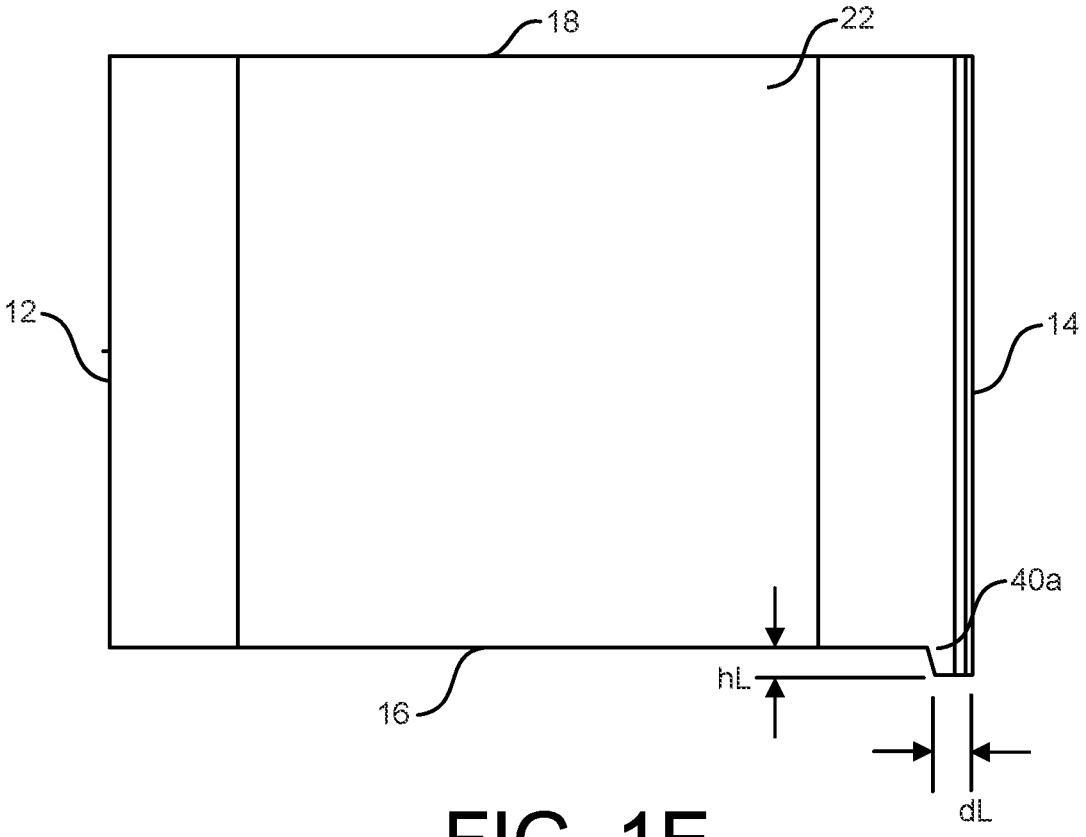
Figure 1F:
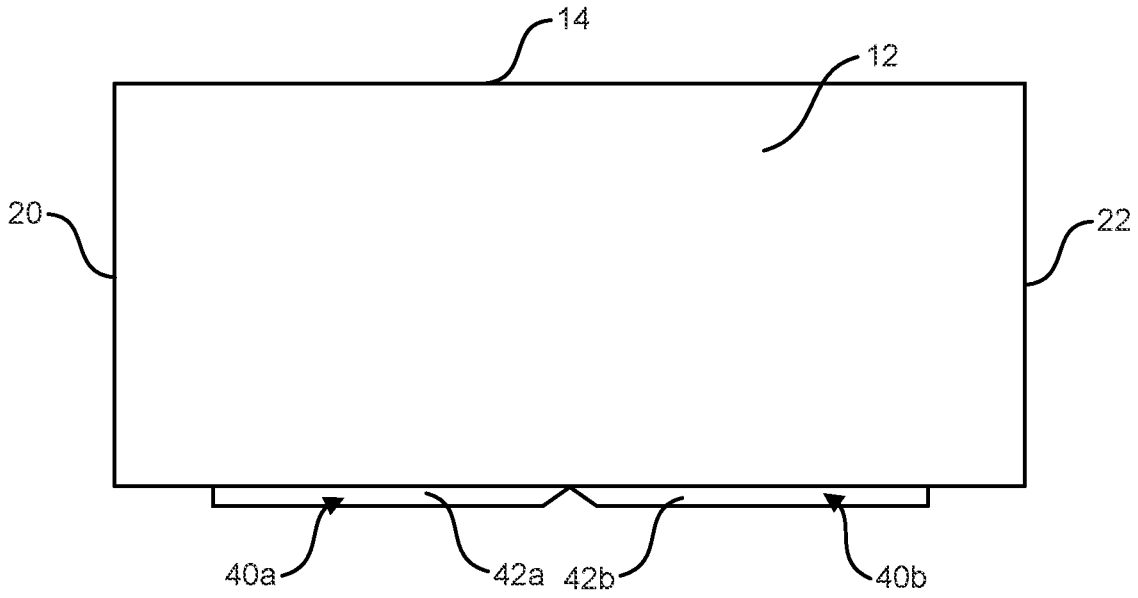
Figure 1G:
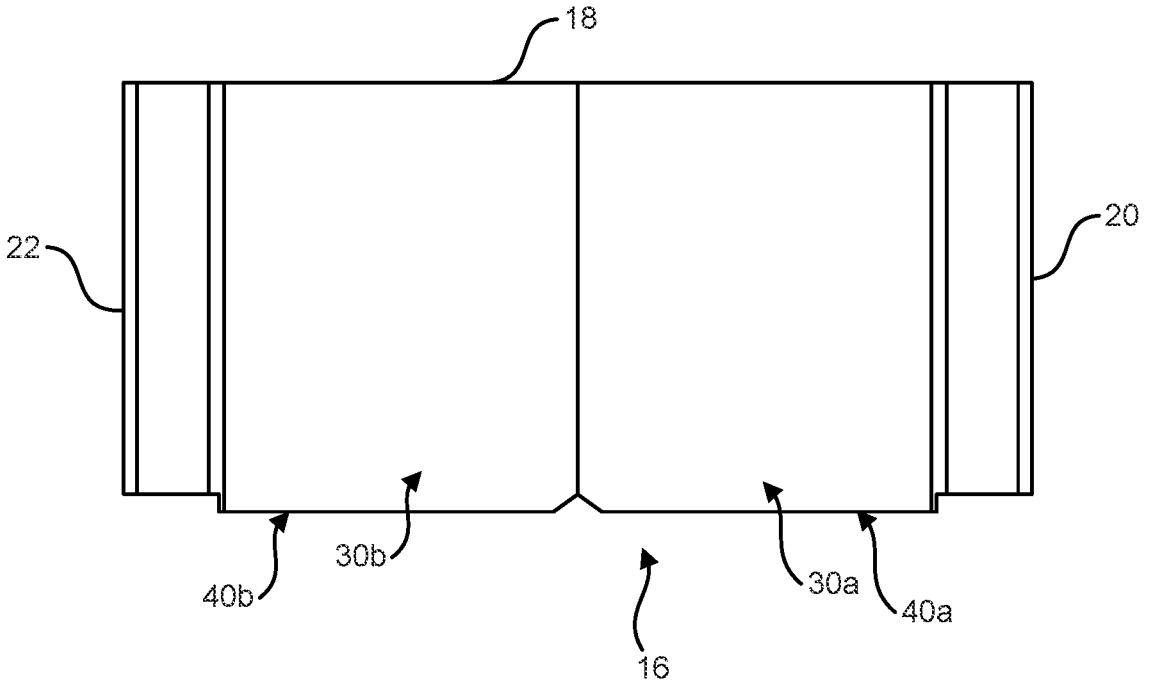
Figure 2A:
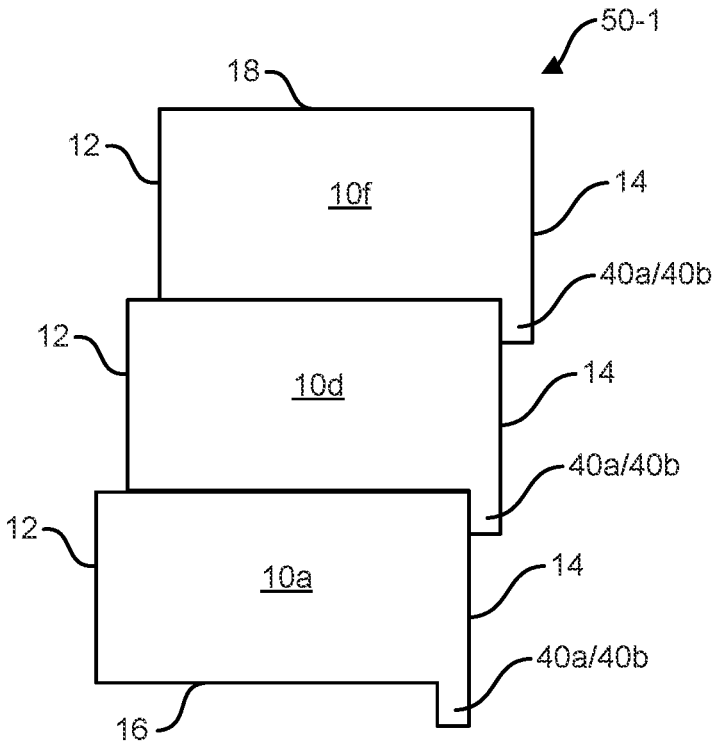
FIGS. 2A-2D respectively illustrate a cross-sectional view of an example wall structure, a front view of an example wall structure, an example convex wall structure, and an example concave wall structure, according to examples of the present disclosure.
Figure 2B:
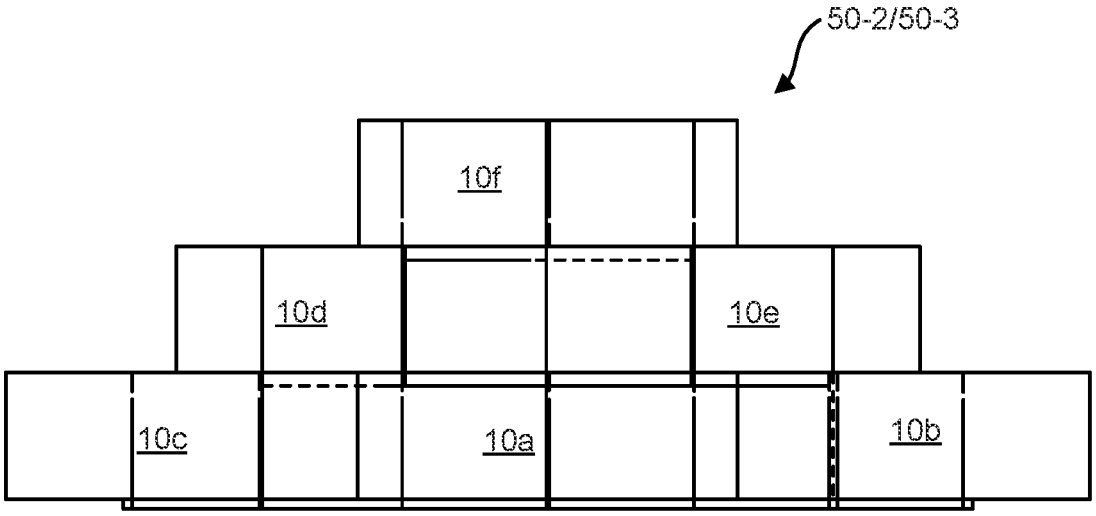
Figure 2C:
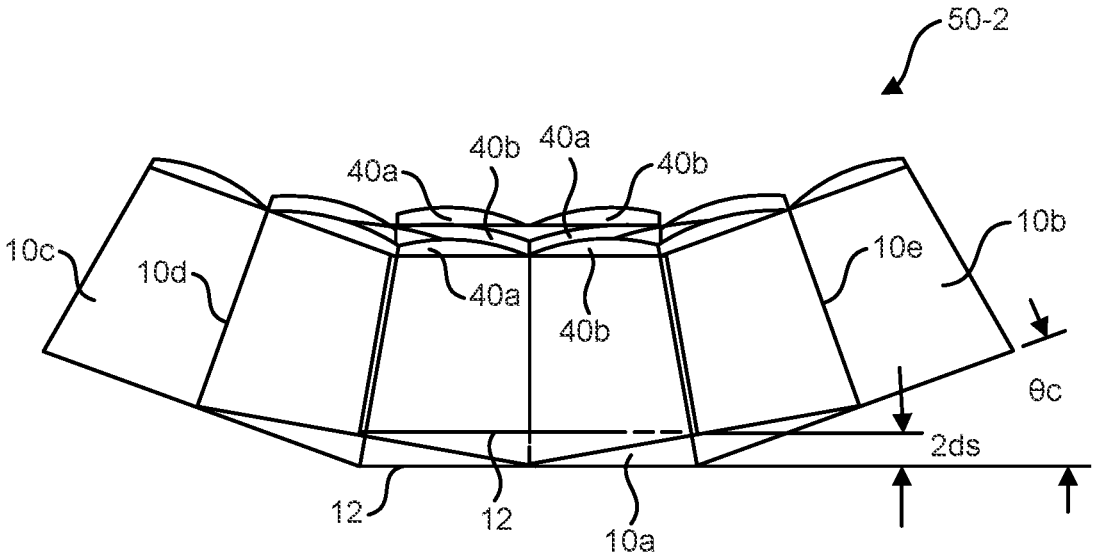
Figure 2D:
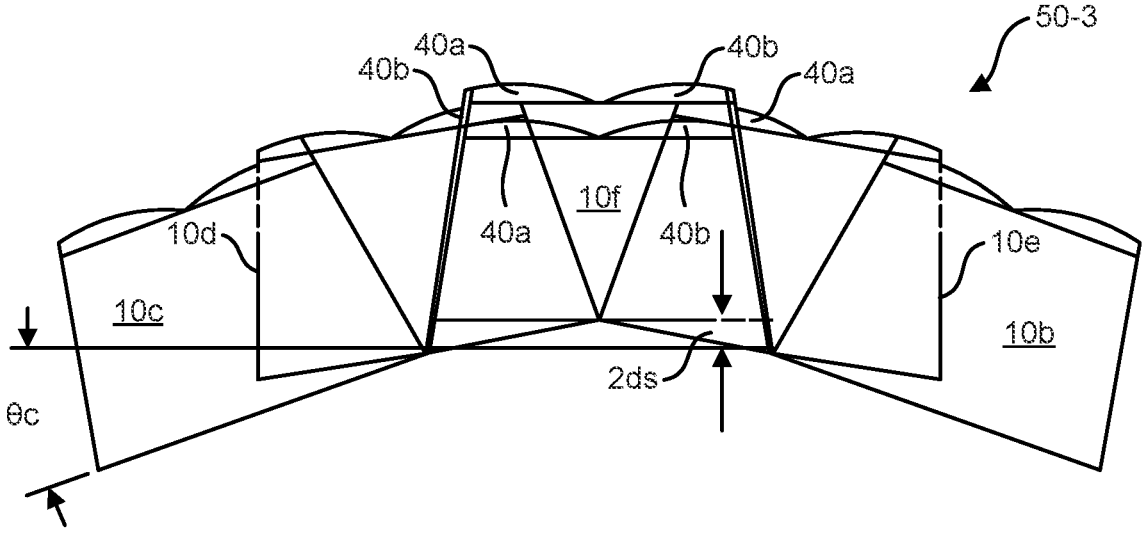

FIGS. 2A-2D illustrate blocks 10 of FIGS. 1A-1G when stacked with a running bond pattern in successive courses to form wall structures, and demonstrate the interaction between curved engagement surfaces 30*a* and 30*b* and setback lips 40*a* and 40*b* of successive block courses to maintain a desired setback distance, $d_S$, for both a convex wall structure (FIG. 2C) and a concave wall structure (FIG. 2D).

FIG. 2A generally illustrates a cross-sectional view through a straight wall structure 50-1 formed by successively stacking blocks 10*a*, 10*d*, and 10*f* on top of one another in successive courses. As illustrated by the example of FIG. 2A, with setback lips 30*a*/30*b* engaged with rear sides 14 of the underlying blocks 10, a desired setback distance, dS, equal to the depth, dL, of setback lips 30*a*/30*b* is formed between front sides 12 of the successive courses of blocks.

FIG. 2B generally illustrates a front view of both a convex wall structure 50-2 and a concave wall structure 50-3 having three courses of blocks arranged in a running bond pattern. A first course of blocks is illustrated by blocks 10*a*, 10*b*, and 10*c*, a second course of blocks is illustrated by blocks 10*d* and 10*e*, and a third course of blocks is illustrated by block 10*f*.

FIG. 2C is a top view generally illustrating convex wall structure 50-2 having an angle of curvature, $\theta_C$. In one example, as illustrated, blocks 10*a*-10*f* have a width, W, of 12 inches, a depth, D, of 8 inches, and are arranged such that wall structure has an angle of curvature, $\theta_C$, of 20 degrees. It is noted that, for clarity, hollow core 10 is not illustrated in FIG. 2C, while blocks 10*a*-10*c* are illustrated with solid lines, and blocks 10*d*-10*f* are illustrated with dashed lines.

As illustrated by FIG. 2C, when stacked to form a convex wall structure, the planar front surfaces of the first and second setback lips 40*a* and 40*b* of a given block 10 are respectively engaged by the by the inner portions 36*b* and 36*a* of the second and first curved engagement surfaces of the pair of blocks 10 in the underlying course of blocks. For example, in FIG. 2C, the planar front surface 42*a* of first setback lip 40*a* of block 10*f* is engaged with the inner portion 36*b* of second curved engagement surface 30*b* of underlying block 10*d*, and the planar front surface 42*b* of second setback lip 40*b* of block 10*f* is engaged with the inner portion 36*a* of the first curved engagement surface 30*a* of underlying block 10*e*, wherein the curvature of the engagement surfaces is such that the desired setback, $d_S$, is maintained between the front faces 12 of successive courses of blocks along convex wall 50-2. For example, when comparing the offset distance between blocks of alternating courses which having the same orientation, such as block 10*a* of the first course of blocks and block 10*f* of the third course of the blocks, the offset distance is equal to $2 \times d_S$, such that the offset desistance between successive courses of blocks 10 is equal to the desired offset distance, $d_S$.

Additionally, it is noted that the transverse centerlines 32 of blocks 10 in alternating courses having the same orientation substantially vertically align with one another, such as the transverse centerlines 32 of blocks 10 and 10*f* being substantially vertically aligned with one another and with the joint between respective sides 22 and 22 of the pair of blocks 10*d* and 10*e* positioned there between. Further, it is also noted that the ¼-points of blocks 10*a* and 10*f* along front sides 12 between first side 20 and the transverse centerline 32 are vertically aligned with one another, and are substantially vertically aligned with ¼-point of block 10*d* along front side 12 between second side 22 and the transverse centerline 32.

Continuing to refer to FIG. 2C, as one reduces the angle of curvature, $\theta_C$, toward zero (such that wall structure 50-2 becomes less convex), the planar front surfaces 42*a* and 42*b* of lips 40*a* and 40*b* of an overlying block 10 will respectively ride along the inner portions of first and second curved engagement surfaces 30*b* and 30*a* of the pair of underlying blocks toward the respective apexes 34*b* and 34*a* while maintaining the desired setback distance, $d_S$, between front faces 12 of blocks 10 of successive courses. Upon the angle of curvature $\theta_C$, being adjusted to zero, such that walls structure 50-2 is a straight wall, the planar front surfaces 42*a* and 42*b* of lips 40*a* and 40*b* of an overlying block 10 are engaged by the respective apexes 34*b* and 34*a* of first and second curved engagement surfaces 30*b* and 30*a* of the pair of underlying blocks, while maintaining the desired setback distance, $d_S$, between the front sides 12 of successive courses of blocks 10.

FIG. 2D is a top view generally illustrating blocks 10 arranged to form a concave wall structure 50-3 having an angle of curvature, $\theta_C$, which is the negative of the angle of curvature of convex wall structure 50-2 of FIG. 2C. In contrast to convex wall structure 50-2, rather than being engaged by the inner portions 36*b* and 36*a*, when stacked to form concave wall structure 50-3, the planar front surfaces of setback lips 40*a* and 40*b* of a given block 10 are respectively engaged by the outer portions 38*b* and 38*a* of the second and first curved engagement surfaces of the pair of blocks 10 in the underlying block course. For example, in FIG. 2D, the planar front surface 42*a* of first setback lip 40*a* of block 10*f* is engaged with the outer portion 38*b* of second curved engagement surface 30*b* of underlying block 10*d*, and the planar front surface 42*b* of second setback lip 40*b* of block 10*f* is engaged with the outer portion 38*a* of the first curved engagement surface 30*a* of underlying block 10*e*, wherein the curvature of the first and second engagement surfaces is such that the desired setback distance, $d_S$, is maintained between front faces 12 of successive courses of blocks 12 of concave wall 50-3.

Continuing to refer to FIG. 2D, as one reduces the angle of curvature, $\theta_C$, toward zero (such that wall structure 50-3 becomes less concave), the planar front surfaces 42*a* and 42*b* of lips 40*a* and 40*b* of an overlying block 10 will respectively ride along the outer portions of first and second curved engagement surfaces 30*b* and 30*a* of the pair of underlying blocks toward the respective apexes 34*b* and 34*a* while maintaining the desired setback distance, $d_S$, between front faces 12 of blocks 10 of successive courses. Upon the angle of curvature $\theta_C$, being adjusted to zero, such that walls structure 50-3 is a straight wall, the planar front surfaces 42*a* and 42*b* of lips 40*a* and 40*b* of an overlying block 10 are engaged by the respective apexes 34*b* and 34*a* of first and second curved engagement surfaces 30*b* and 30*a* of the pair of underlying blocks, while maintaining the desired setback distance, $d_S$, between the front sides 12 of successive courses of blocks 10.

In view of the above, by employing curved engagement surfaces on the rear side of a retaining wall block to engage set back lips of overlying blocks when stacked in successive courses for form structures (e.g., walls), in accordance with the present disclosure, a consistent and desired setback distance is able to be maintained between the front sides of retaining wall blocks of successive courses of straight wall structures, convex wall structures, and concave wall structures.

FIGS. 3A-3G respectively illustrate perspective, bottom side, top side, first side, second side, front side, and rear side views of retaining wall block 10, according to another example of the present disclosure. According to the examples of FIGS. 3A-3G, in lieu of curved engagement surfaces 30*a* and 30*b* comprising spline curves fitted to a number of modeled control points (not having a consistent or single radius), as illustrated by FIGS. 1A-1G, curved engagement surfaces 30*a* and 30*b* are arc segments having a single radius which approximates the fitted spline curves of engagement surfaces 30*a* and 30*b* of FIGS. 1A-1G.

Figure 3A:
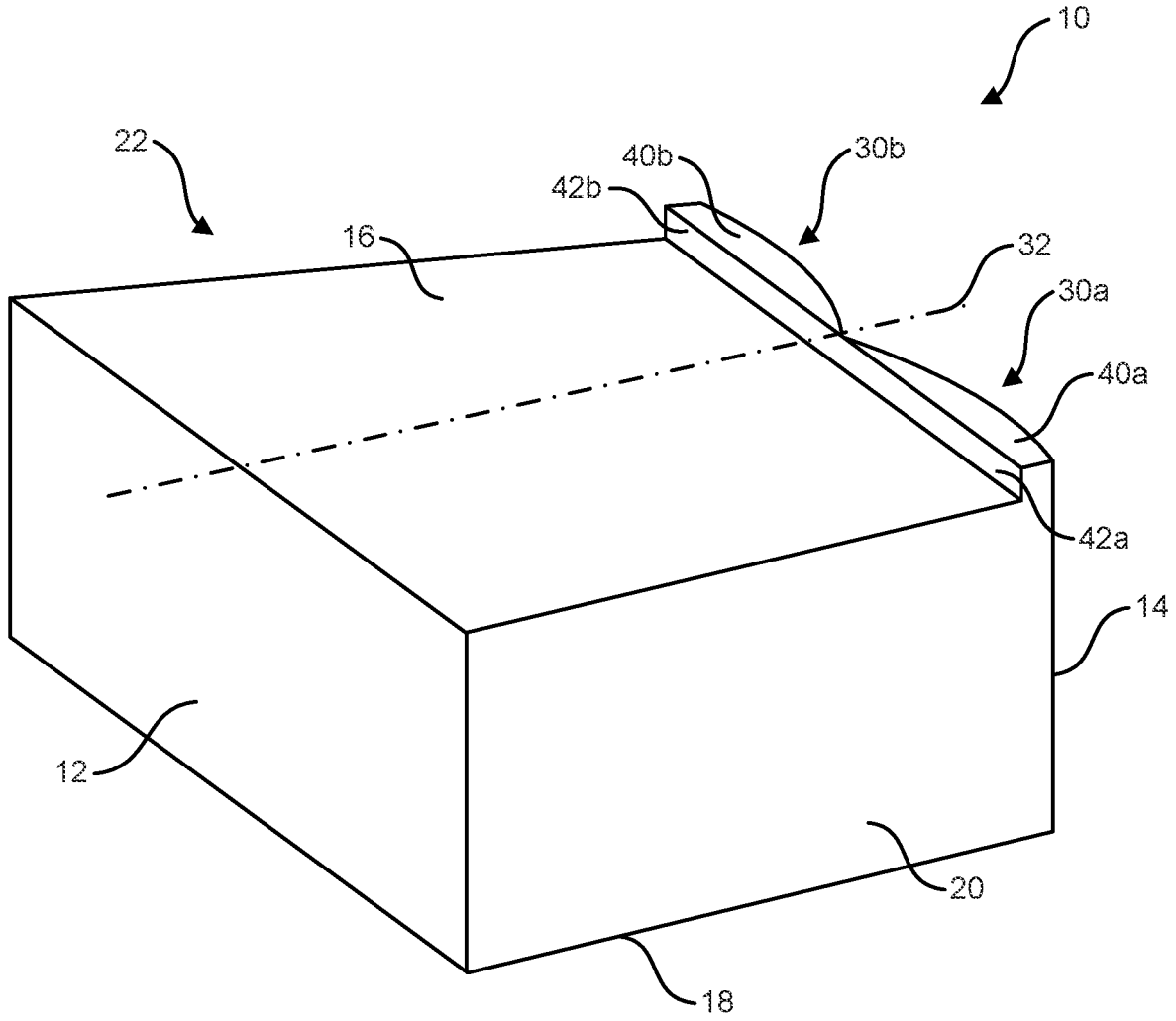
FIGS. 3A to 3G generally illustrate a perspective, bottom, top, first side, second side, front, and rear views of a retaining wall block, according to one example.
Figure 3B:
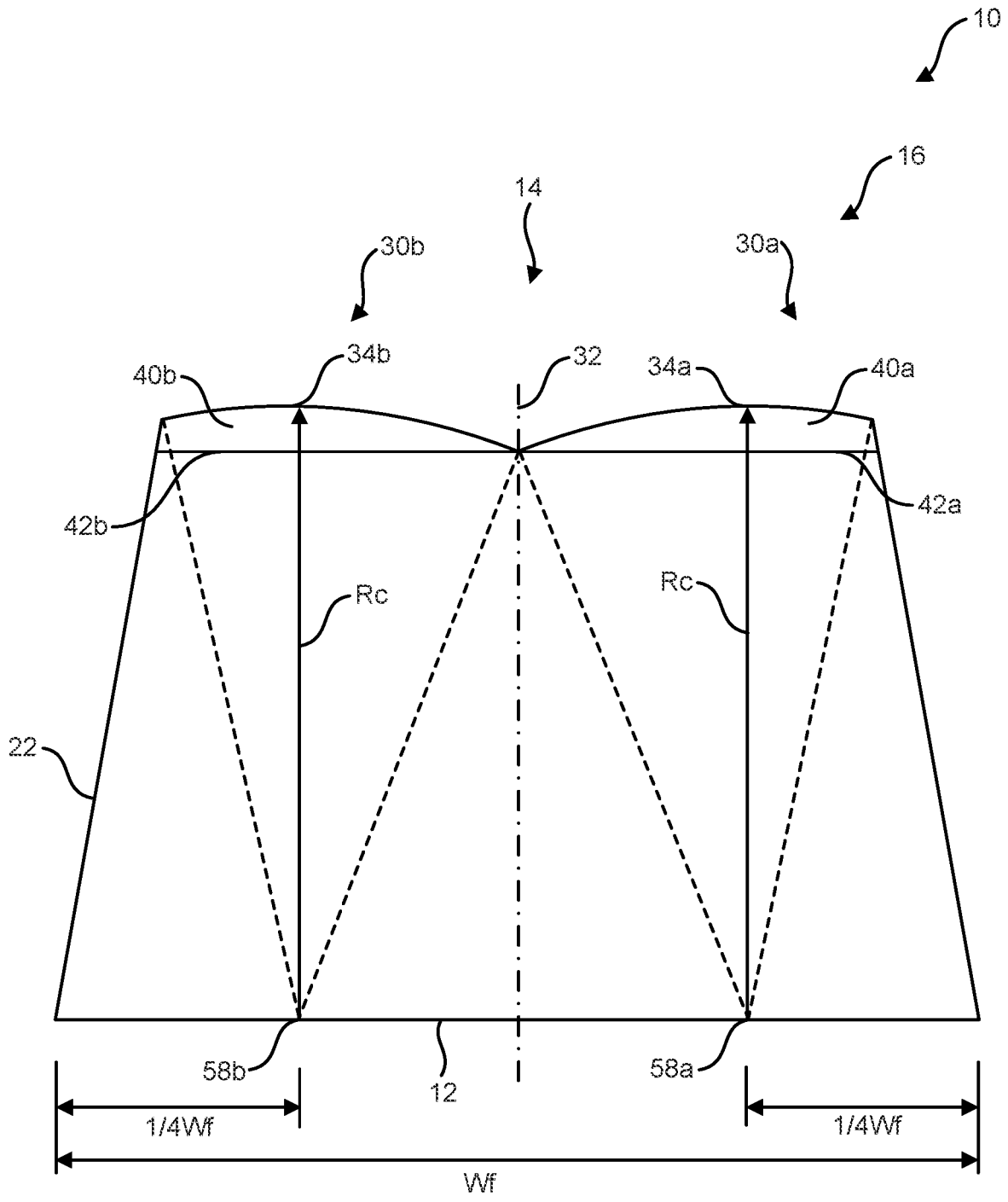
Figure 3C:
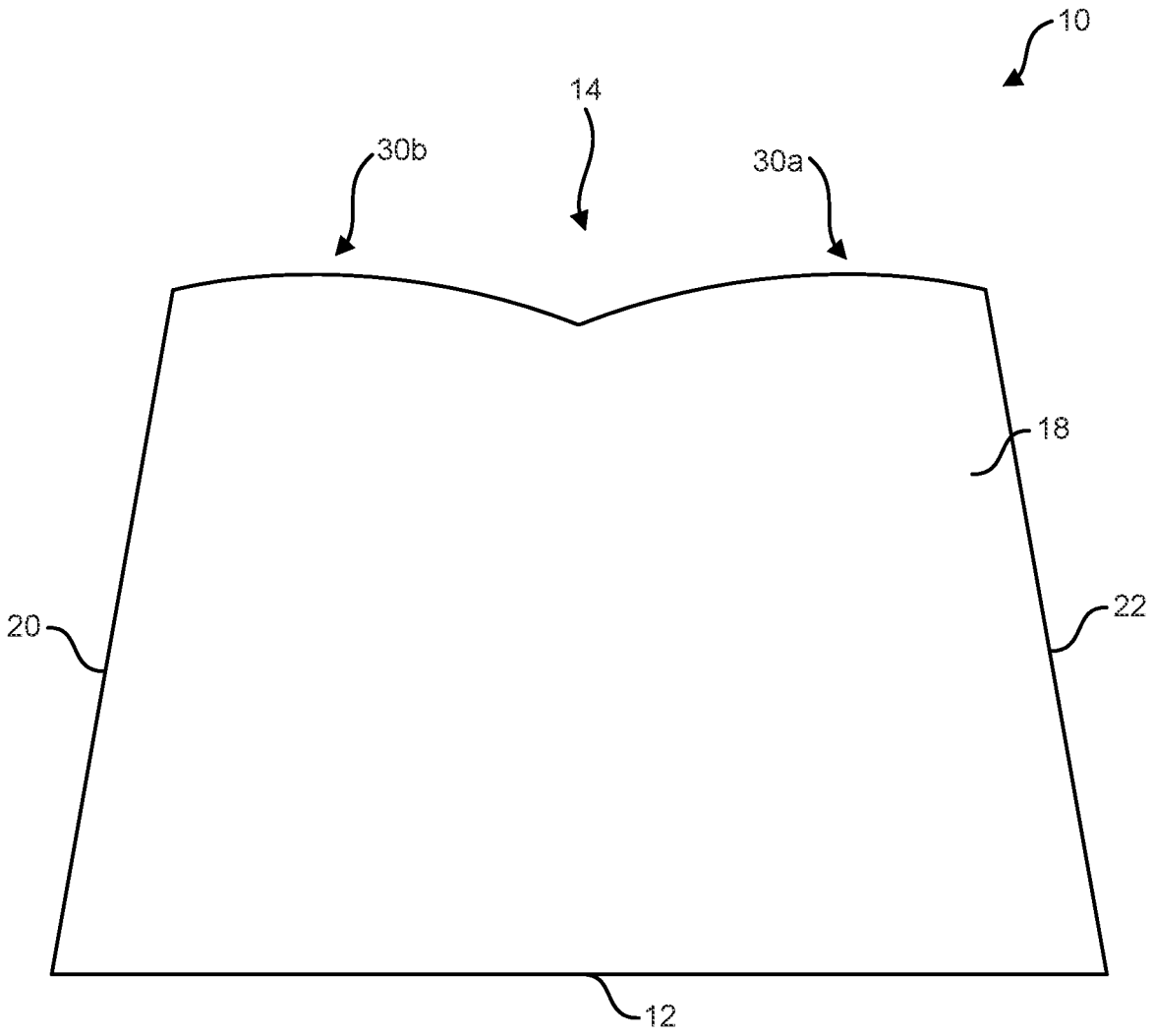
Figure 3D:
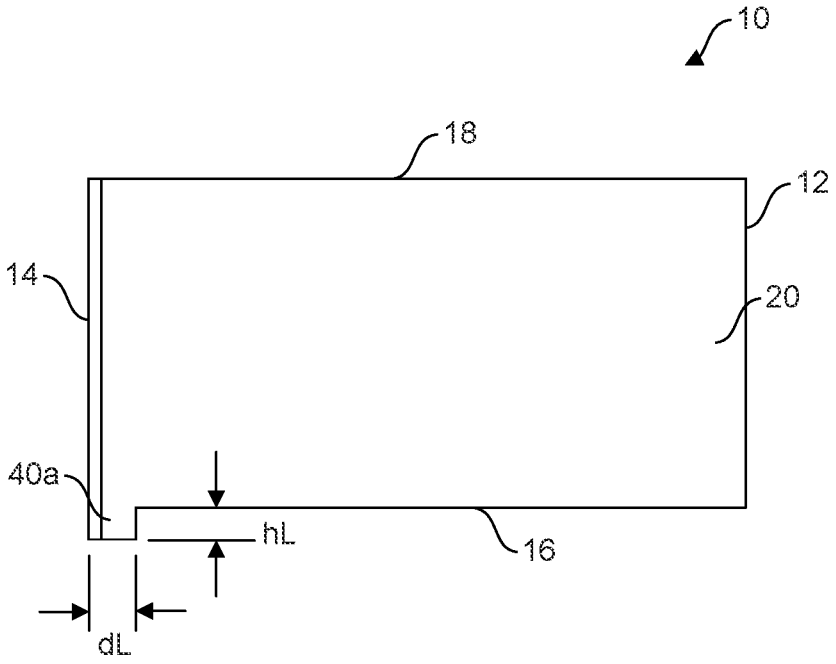
Figure 3E:
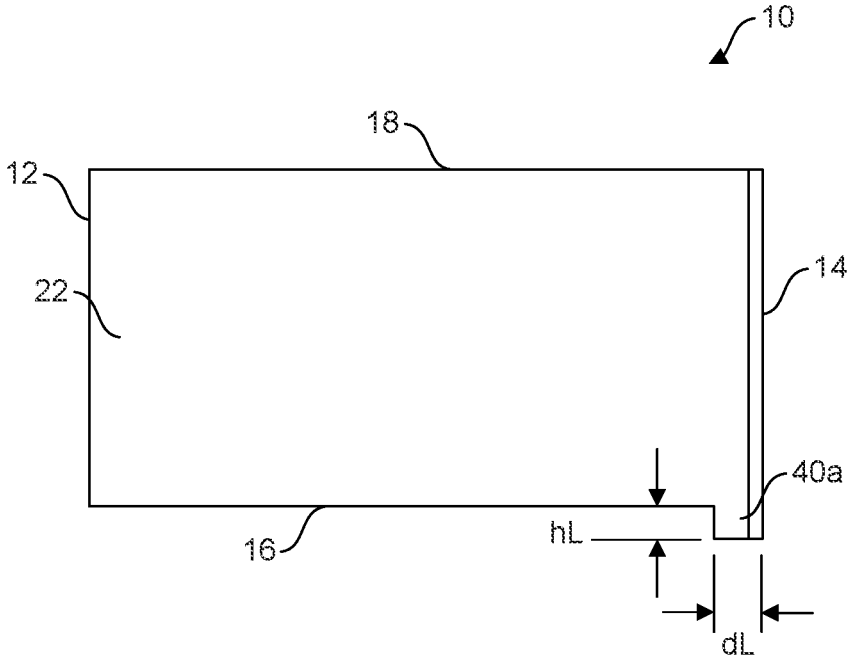
Figure 3F:
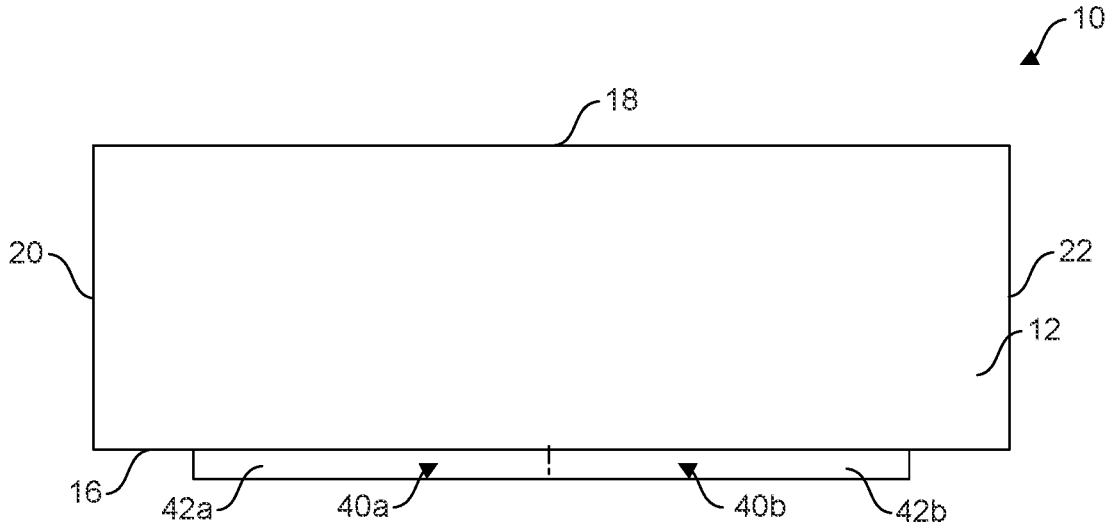
Figure 3G:
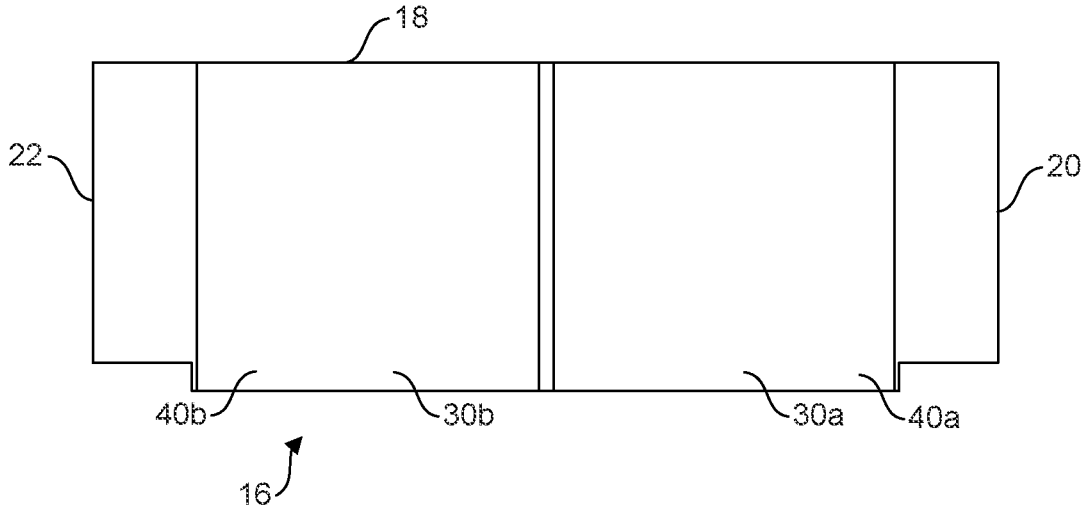

In one example, with reference to FIG. 3B, first and second curved engagement surfaces 30*a* and 30*b* comprise arcs having a radius of curvature, $R_C$, equal to the depth, D, of retaining wall block 10, where the respective center points of the arcs are at the corresponding ¼—points 58*a* and 58*b* of the width, W, along front side 12. While the arcuate segments with radius, $R_C$, of first and second curved engagement surfaces 30*a* and 30*b* of the implementation of FIGS. 3A-3G may result in slight variations of the desired setback distance, $d_S$, between front sides 12 of retaining wall blocks 10 when arranged to form convex and concave wall structures (e.g., convex and concave wall structures 50-2 and 50-3) as compared to the fitted spline curve of the implementation of FIGS. 1A-1G, such arc segments are easier and less costly to machine when forming concrete molds for forming retaining wall blocks 10.

FIGS. 4A-4G respectively illustrate perspective, bottom side, top side, first side, second side, front side, and rear side views of retaining wall block 10, according to still another example of the present disclosure. According to the examples of FIGS. 4A-4G, in lieu of curved engagement surfaces 30*a* and 30*b* comprising spline curves fitted to a number of modeled control points (not having a consistent or single radius), as illustrated by FIGS. 1A-1G, curved engagement surfaces 30*a* and 30*b* comprise a series of line segments which approximate the fitted spline curves of engagement surfaces 30*a* and 30*b* of FIGS. 1A-1G.

Figure 4A:
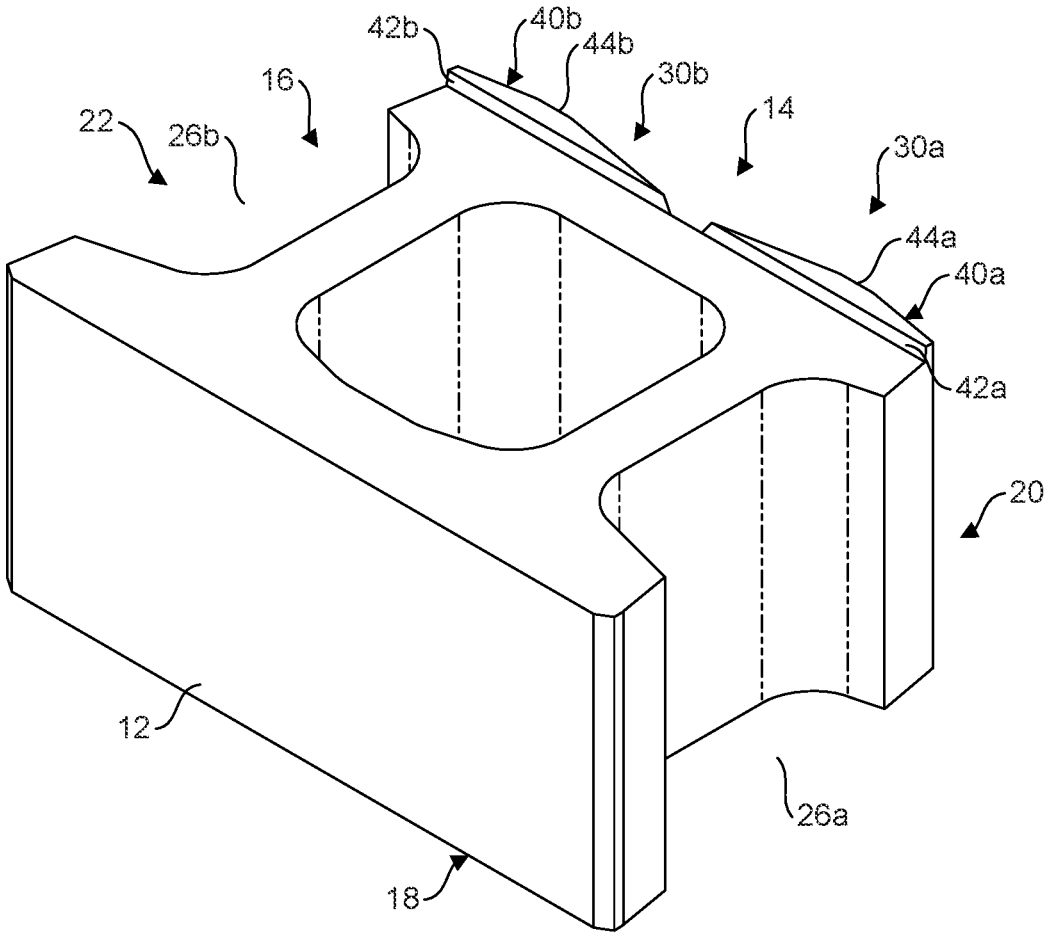
FIGS. 4A to 4G generally illustrate a perspective, bottom, top, first side, second side, front, and rear views of a retaining wall block, according to one example.
Figure 4B:
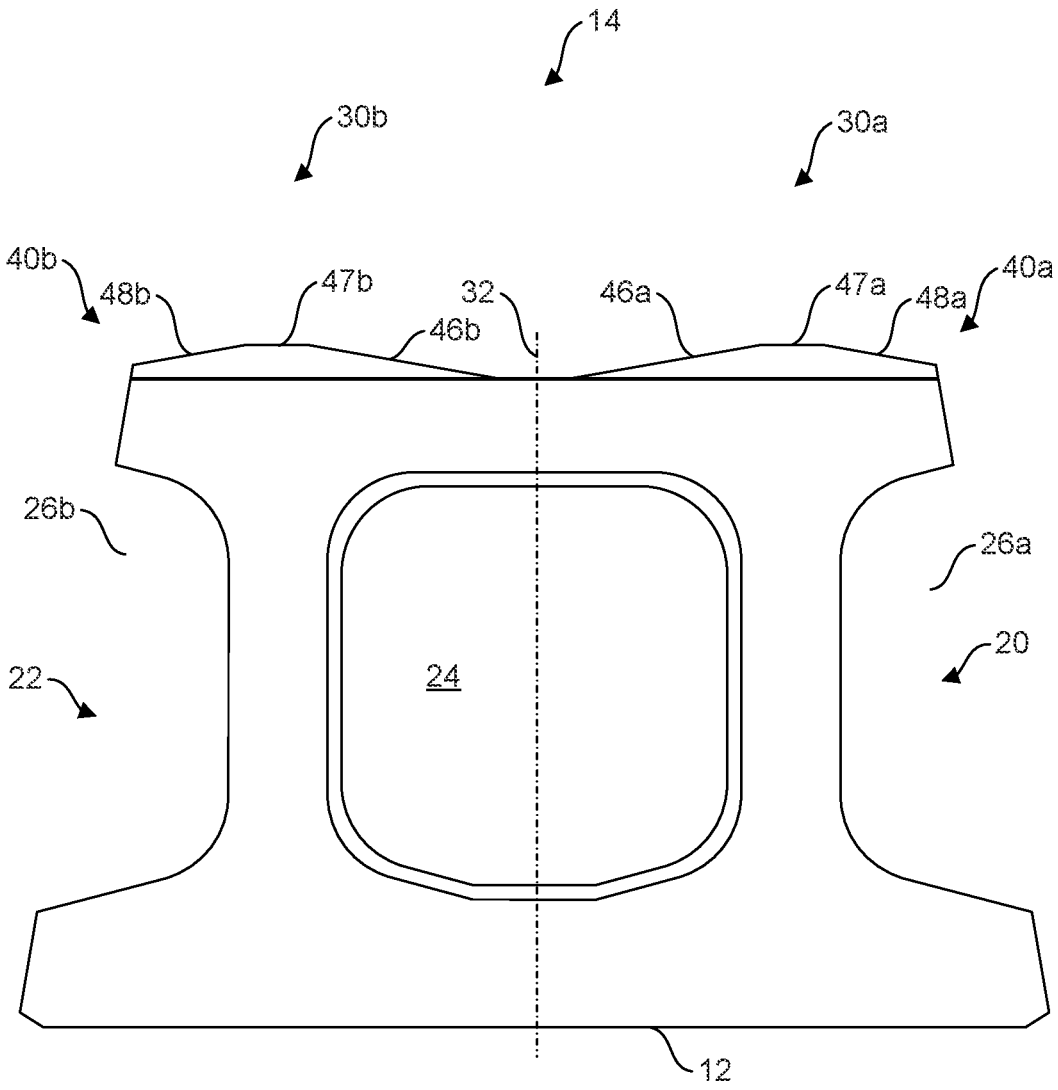
Figure 4C:
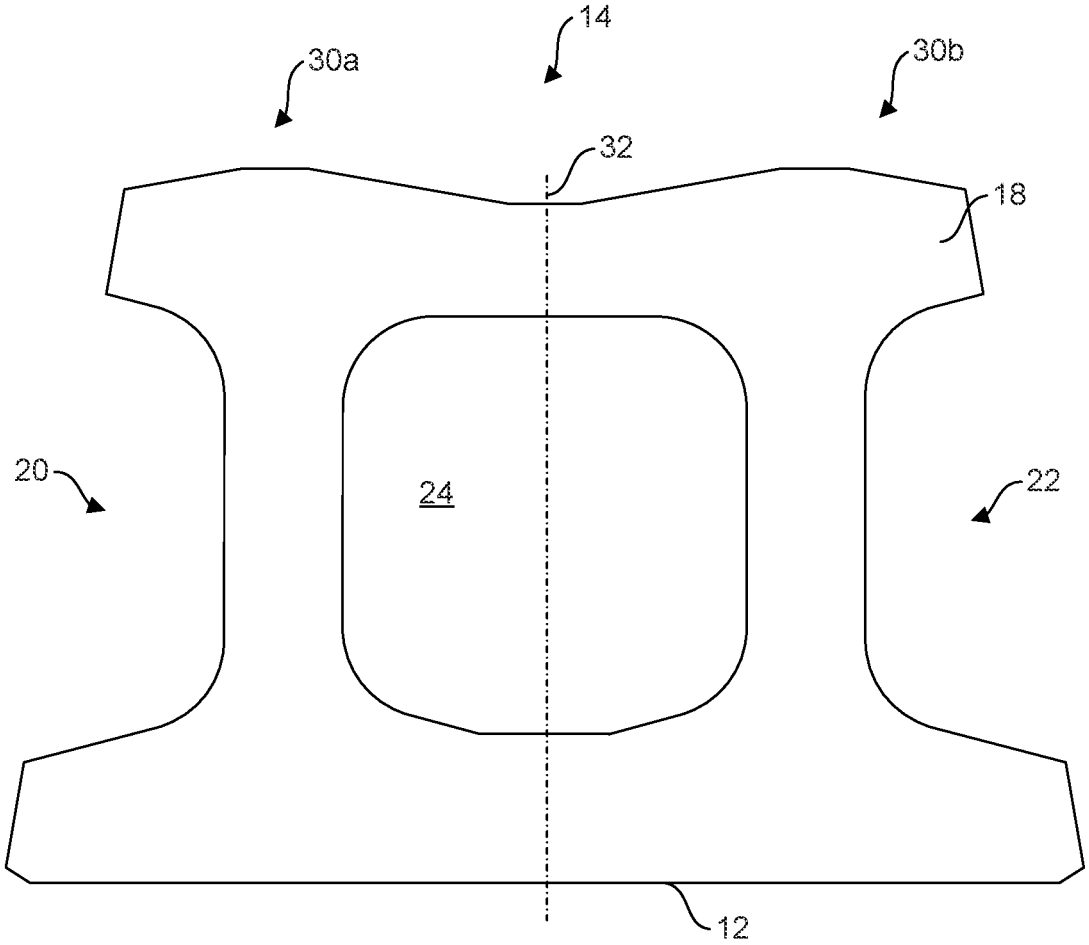
Figure 4D:
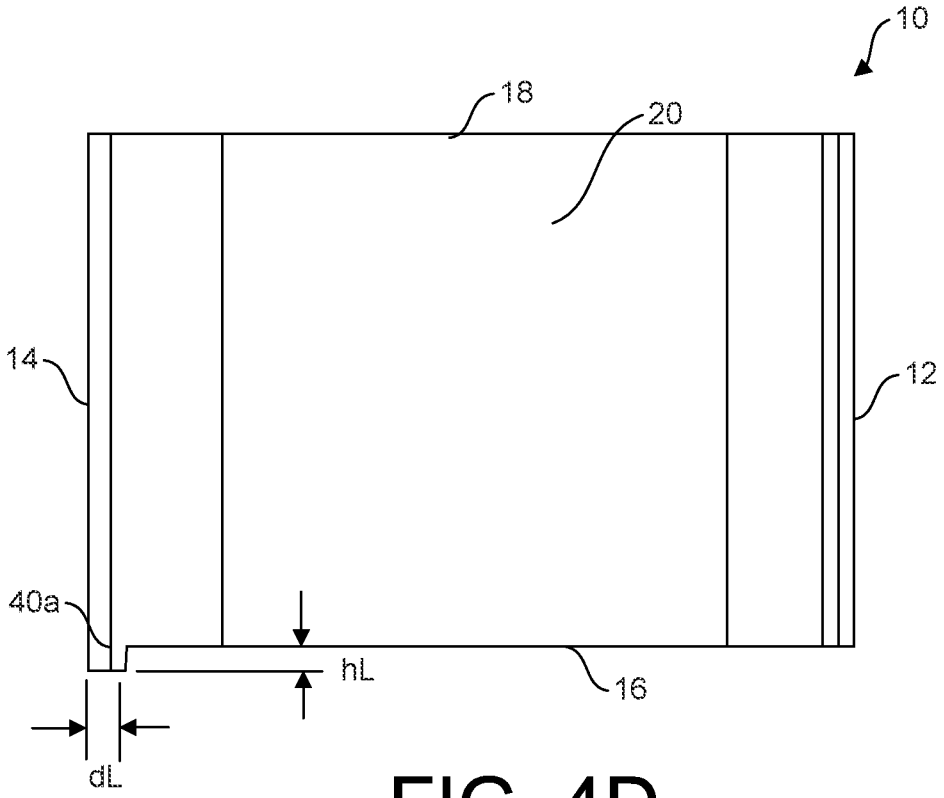
Figure 4E:
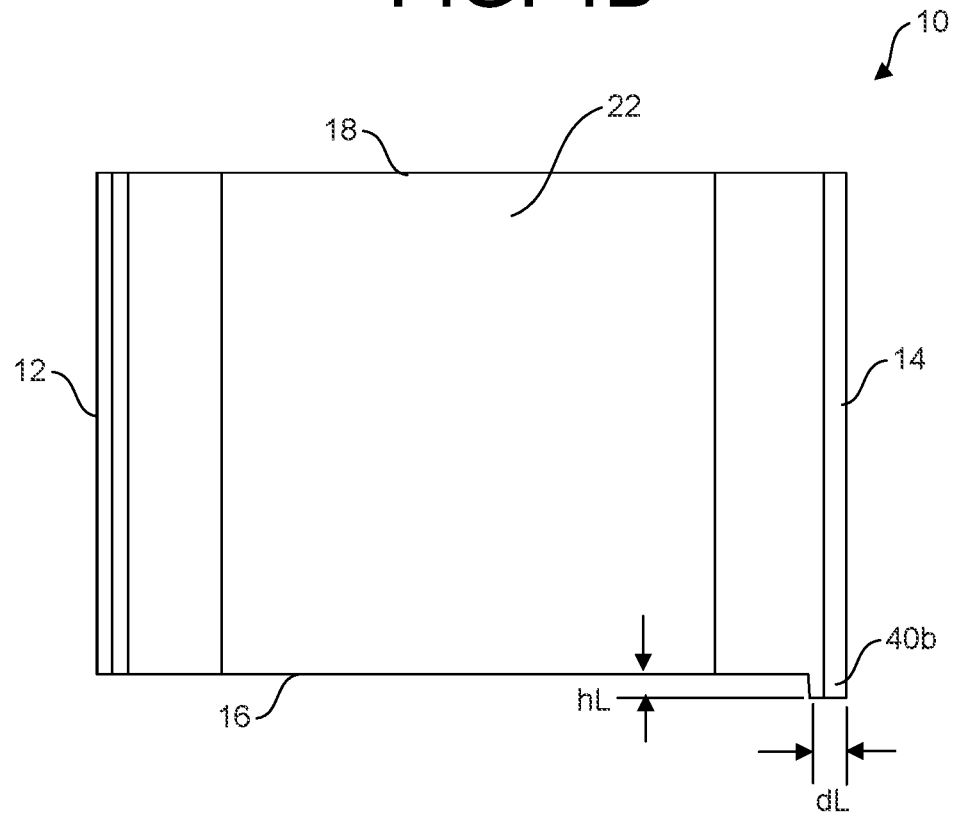
Figure 4F:
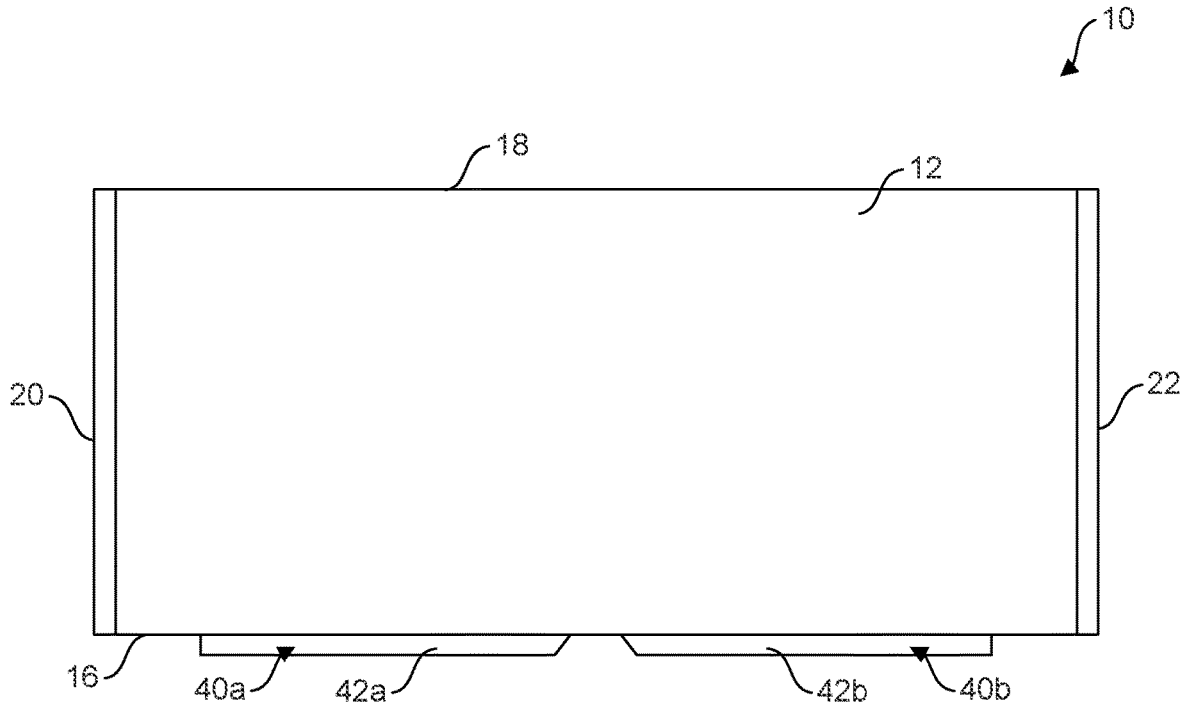
Figure 4G:
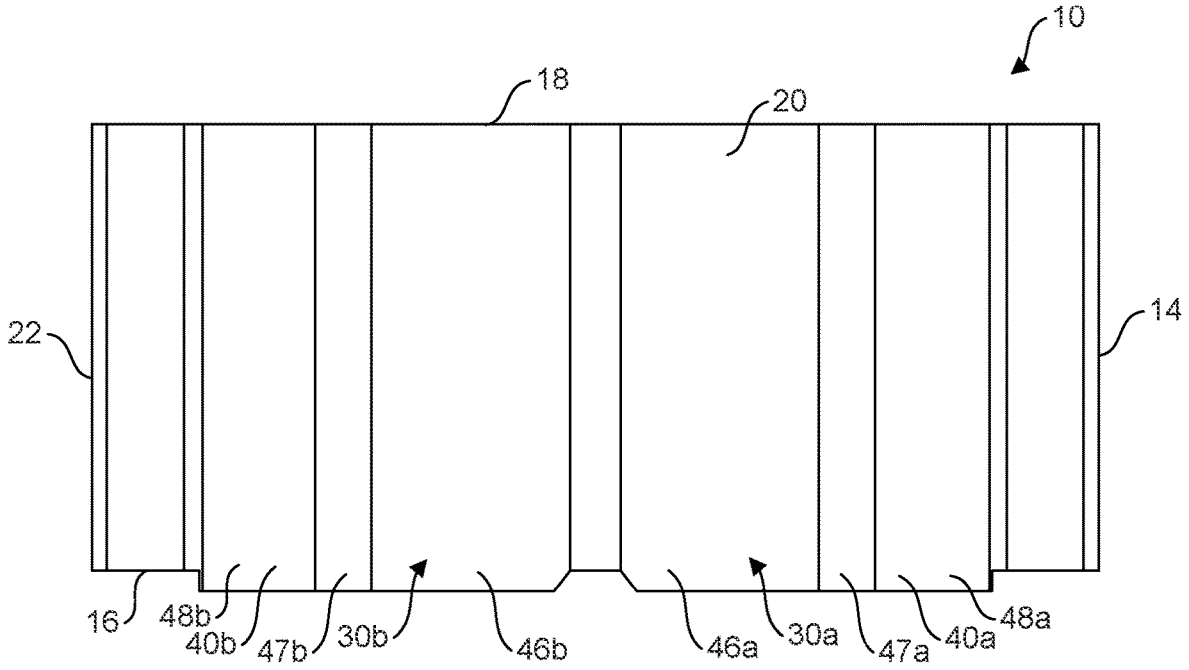

In one example, with reference to FIG. 4B, first and second curved engagement surfaces 30*a* and 30*b* each comprise a series of three line segments, with first engagement surface 30*a* including line segments 46*a*, 47*a*, and 48*a*, and second engagement surface 30*b* including line segments 46*b*, 47*b*, and 48*b*, where line segments 46*a* and 46*b* respectively corresponding to inner portions 36*a* and 36*b* of the fitted spline curves of FIG. 1B, line segments 48*a* and 48*b* respectively corresponding to outer portions 38*a* and 38*b* of the fitted spline curves of FIG. 1B, and line segments 47*a* and 47*b* corresponding to the apexes 34*a* and 34*b* of the fitted spline curves of FIG. 1B. In one example, a center point of each of the line segments 47*a* and 47*b* respectively correspond to apexes 34*a* and 34*b* of the fitted spline curves of FIG. 1B.

While the series of lines segments of first and second curved engagement surfaces 30*a* and 30*b* of the implementation of FIGS. 4A-34 may result in slight variations of the desired setback distance, $d_S$, between front sides 12 of retaining wall blocks 10 when arranged to form convex and concave wall structures (e.g., convex and concave wall structures 50-2 and 50-3) as compared to the fitted spline curve of the implementation of FIGS. 1A-1G, the series of line segments are easier and less costly to machine when forming concrete molds for forming retaining wall blocks 10.

FIGS. 5A-5G respectively illustrate perspective, bottom side, top side, first side, second side, front side, and rear side views of retaining wall block 10, according to yet another example of the present disclosure. Wall block 10 of FIGS. 5A-5G is the same as wall block 10 of FIGS. 4A-4G, but additionally includes a notch 60 in top side 18 along an edge of block 10 formed by top side 18 and rear side 14, where notch 60 is configured to receive setback lips 40*a* and 40*b* (which are configured to "nest" within notch 60). As will be described below, a depth of notch 60 together with the depth, $d_L$, of setback lips 40*a* and 40*b* enable the desired setback distance, $d_S$, between the front sides 12 of blocks of successive courses to be adjusted over a range of values (and thereby adjust a setback angle of a wall structure).

According to one example, notch 60 includes a vertical surface 62, which extends between bottom and top sides 16 and 18, and which includes curved engagement surfaces 30*a* and 30*b* to engage planar front surfaces 42*a* and 42*b* of setback lips 40*a* and 40*b* of overlying blocks 10 when stacked in courses. Notch 60 further includes a horizontal surface 64, which is parallel with top surface 18. Notch 60 has a depth, $d_N$, and a height, $h_N$.

Figure 5A:
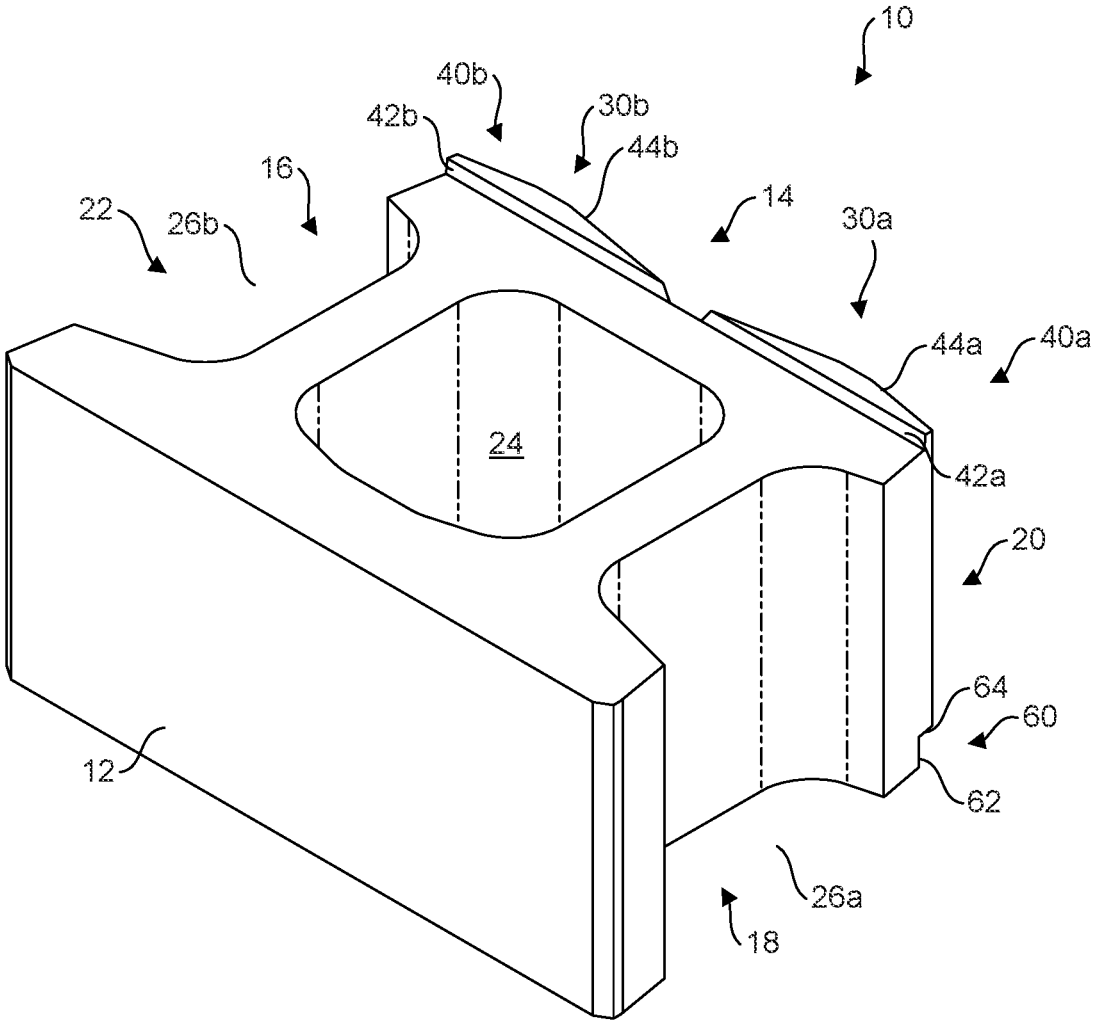
FIGS. 5A to 5G generally illustrate a perspective, bottom, top, first side, second side, front, and rear views of a retaining wall block, according to one example.
Figure 5B:
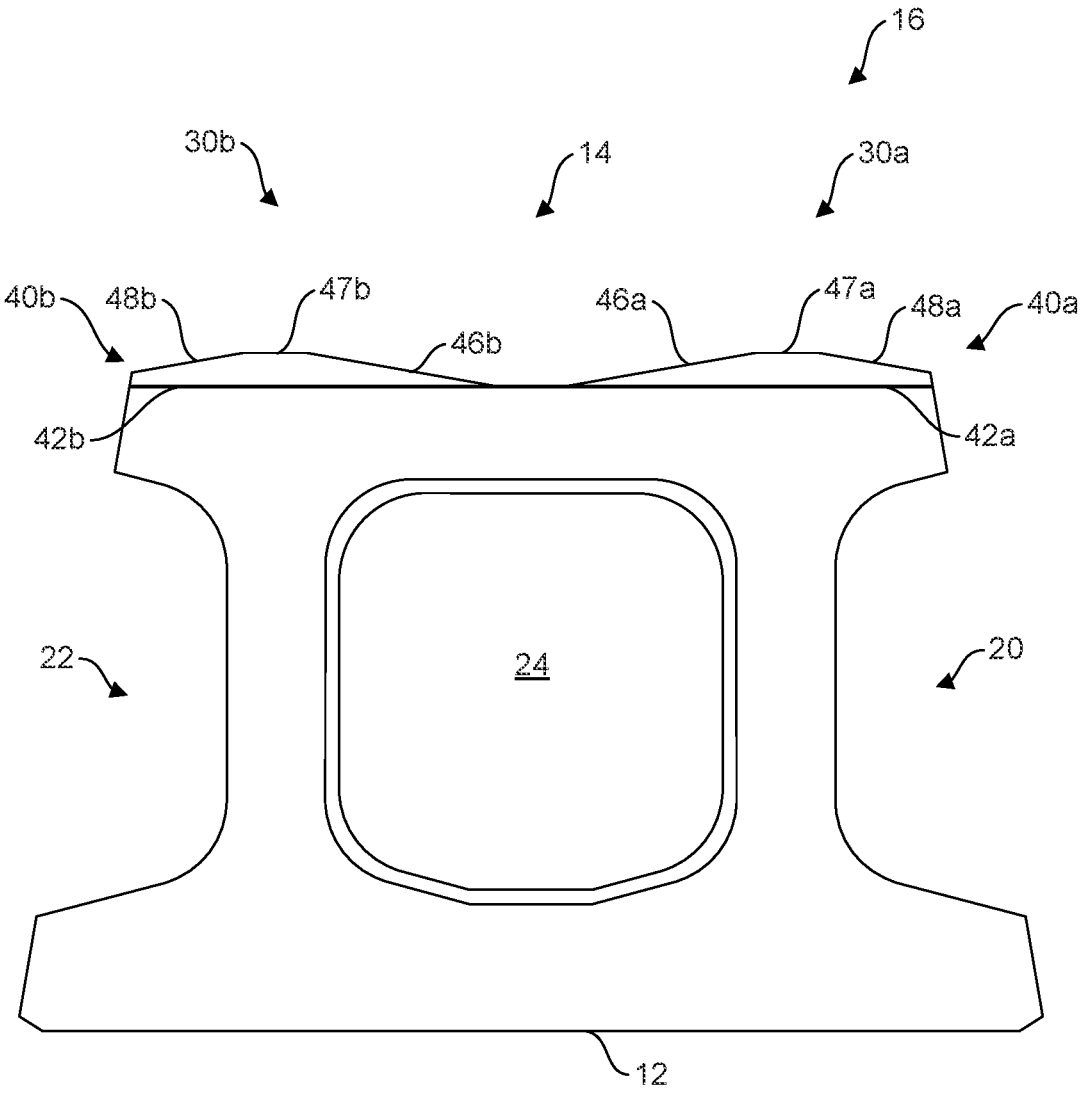
Figure 5C:
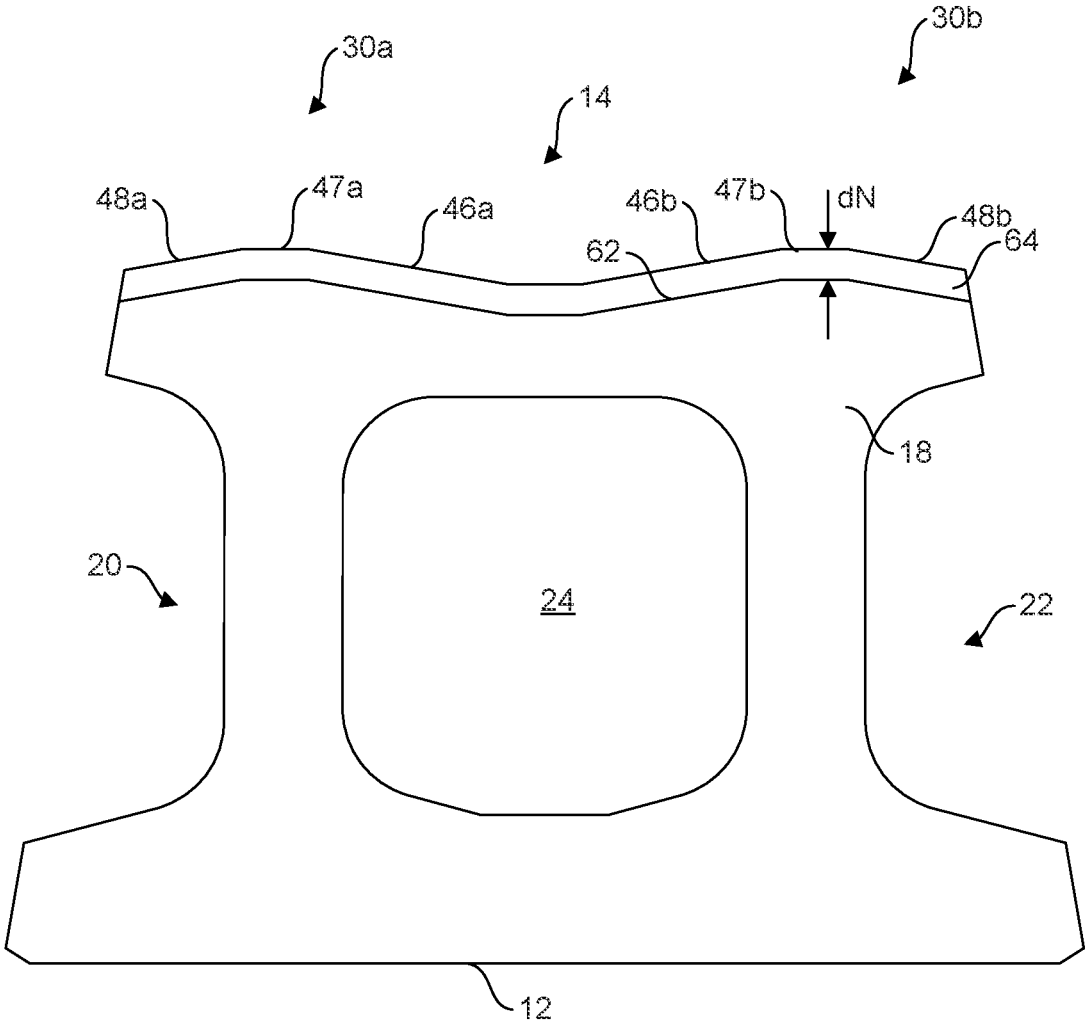
Figure 5D:
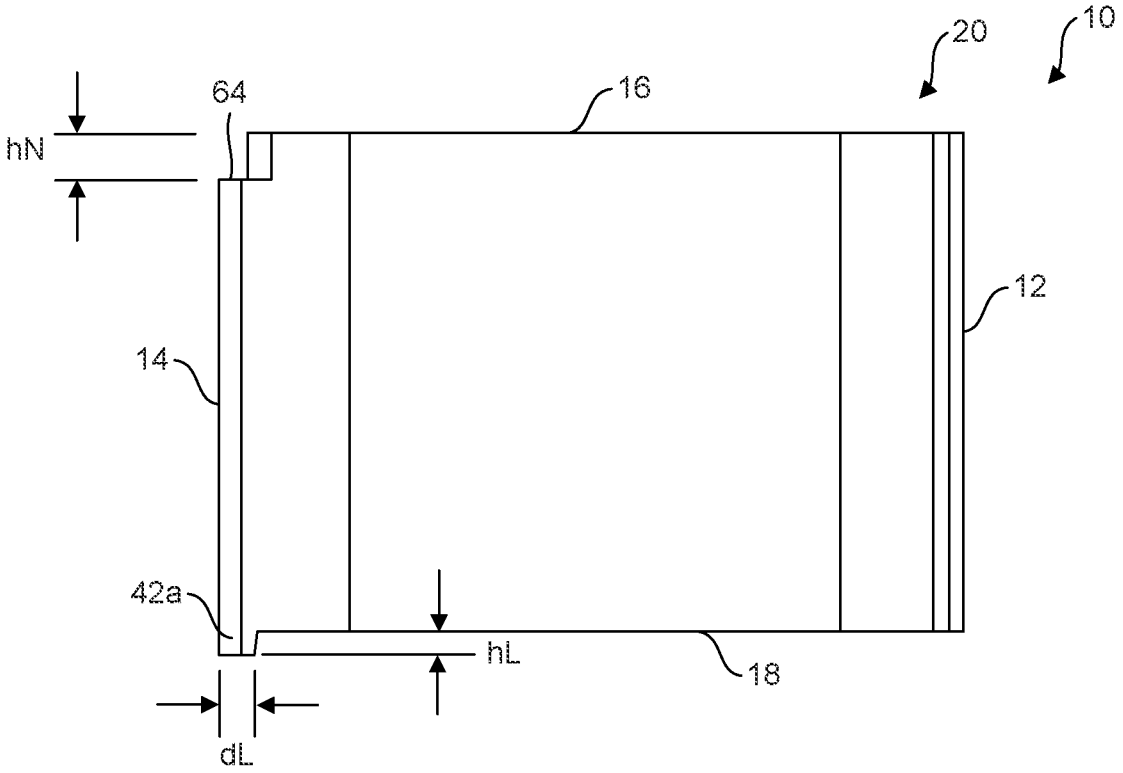
Figure 5E:
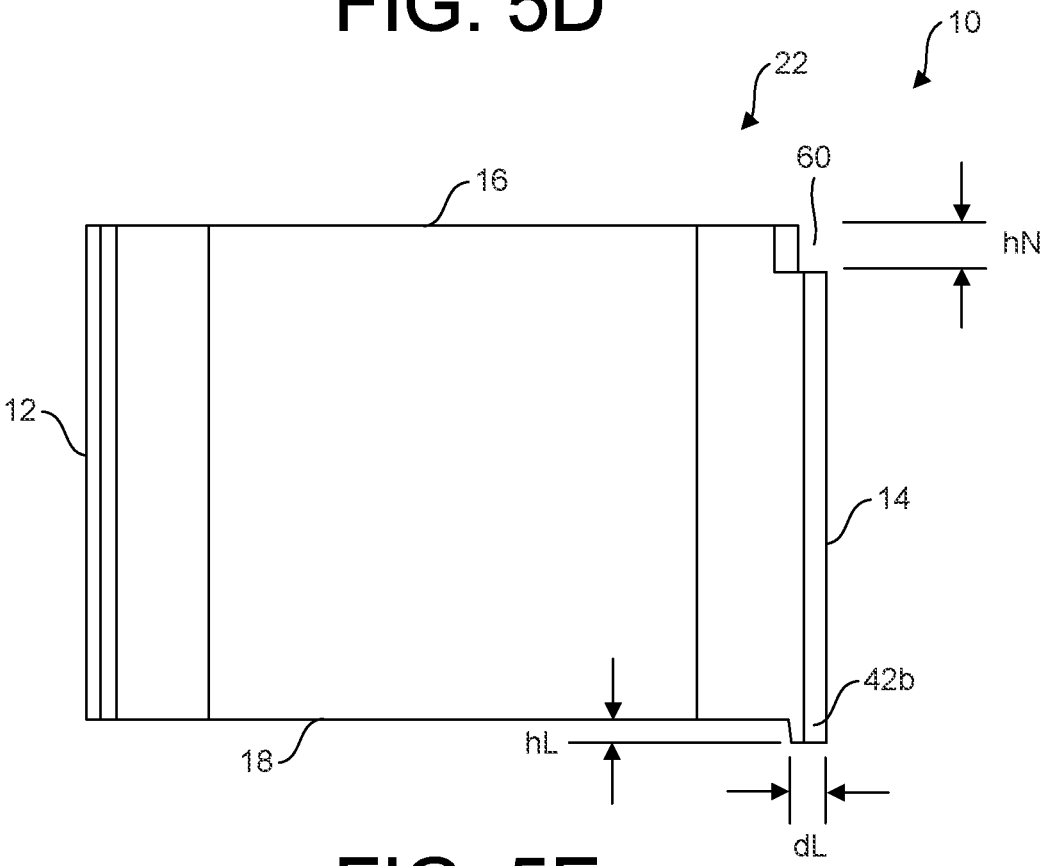
Figure 5F:
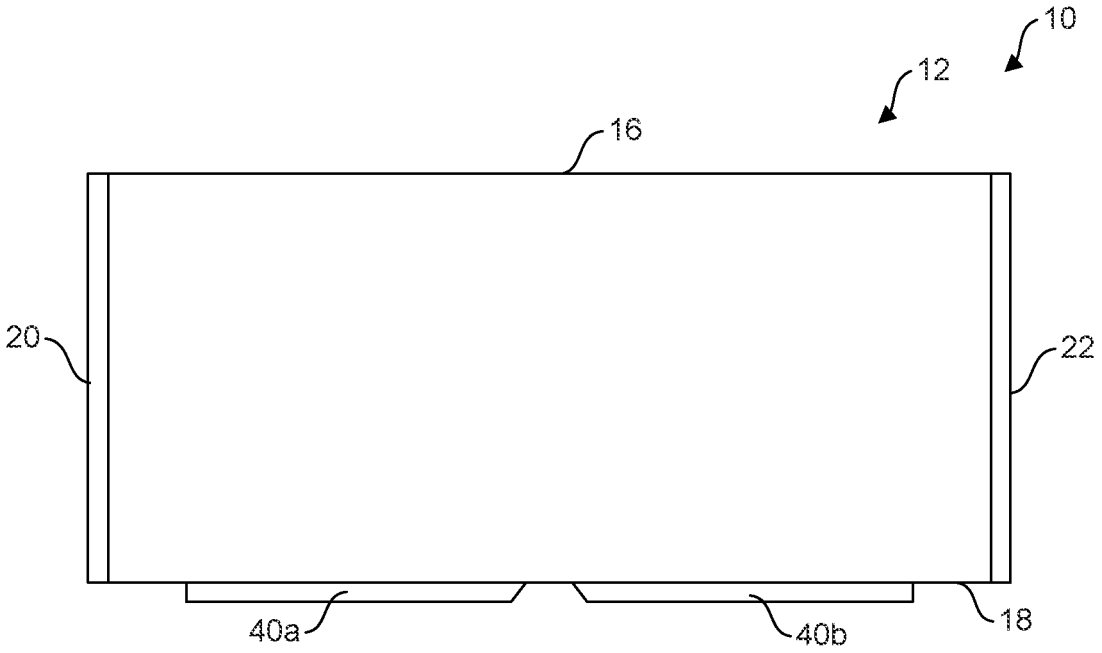
Figure 5G:
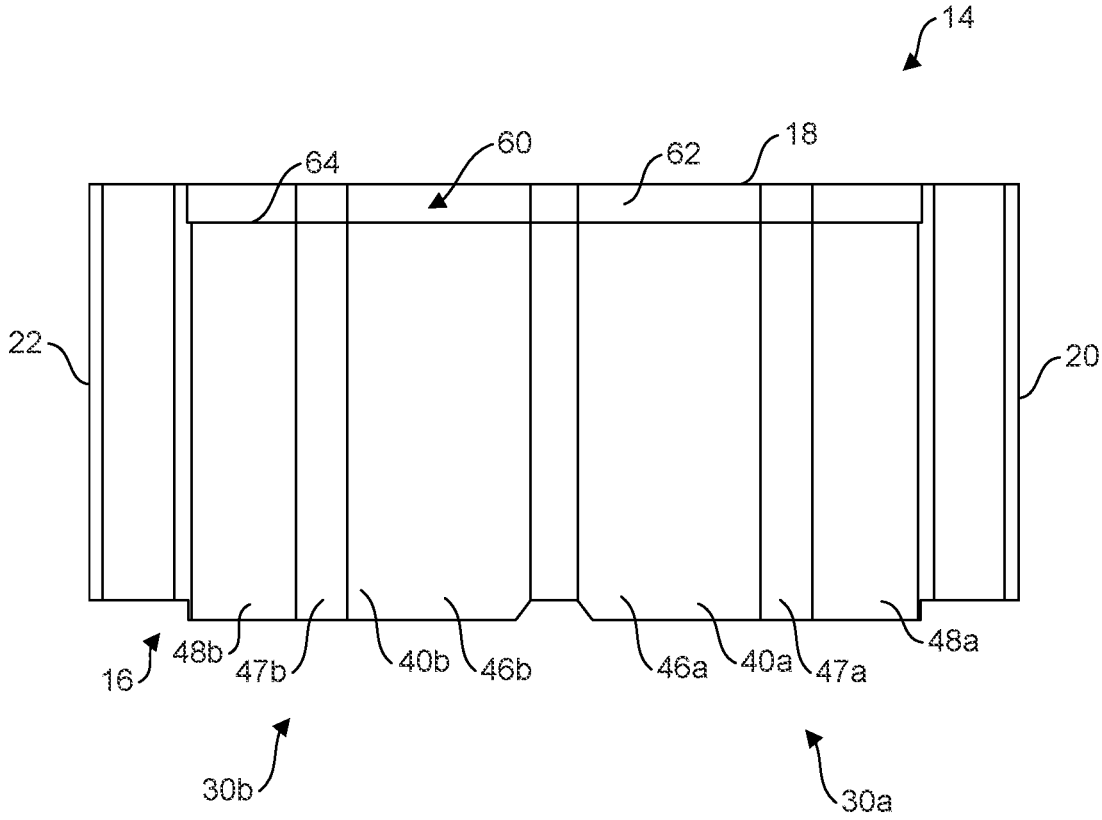
Figure 5H:
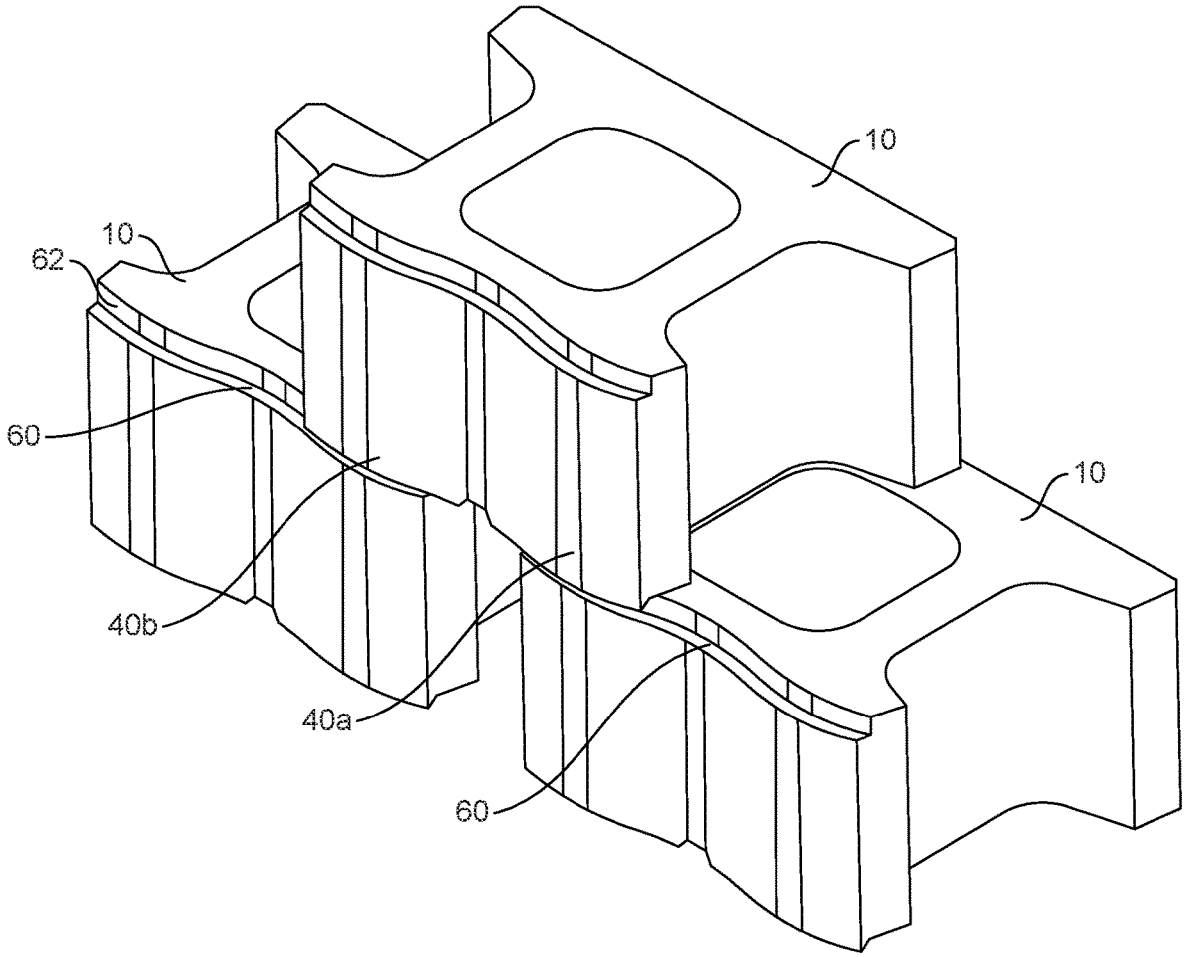
FIG. 5H generally illustrates a wall structure employing blocks illustrated by FIGS. 5A to 5G, according to one example.

FIG. 5H is a rear side perspective view illustrating a number of blocks 10 of FIGS. 5A-5G stacked to form a wall structure and illustrates setback lips 40*a*/40*b* of the upper block 10 nested within the notches 60 of the pair of underlying blocks 10, such that the planar front surfaces of setback lips 40*a* and 40*b* respectively engage the curved engagement surfaces 30*b* and 30*a* on the vertical surfaces 62 of the underlying pair of blocks 10.

Figures 6A, 6B, 6C, 6D, 6E:
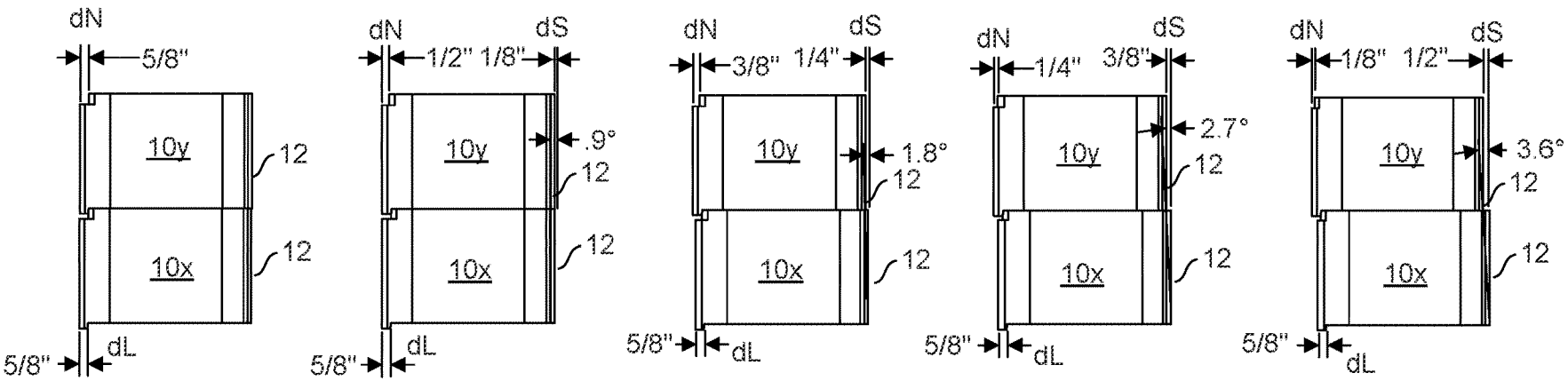
FIGS. 6A to 6F generally illustrate cross-sectional views of example wall structures employing blocks illustrated by FIGS. 5A to 5G, according to one example.

FIGS. 6A to 6F are cross-sectional views through a pair of stacked blocks 10*x* and 10*y*, according to the example of FIGS. 5A-5H. In FIGS. 6A-6E, it is noted that the depth, $d_L$, of setback lip 40*a*/40*b* remains constant (i.e., ⅝-inch), while the depth, $d_N$, of notch 60 decreases in each successive example such that the setback distance, $d_S$, between the front sides 12 of the blocks 10*x* and 10*y* increases with each example. In FIG. 6A, the depth, $d_N$, of notch 60 is the same as the depth, $d_L$, of setback lips 40*a*/40*b* (i.e., both are ⅝ inch) so that the front sides of the blocks 10 vertical align and there is not setback distance between blocks 10*x* and 10*y* (i.e., $d_S$=0). In each successive remaining example, 6B to 6E, the depth, $d_N$, of notch 60 decreases by ⅛ inch, such that the offset distance, $d_S$, between front faces 12 of blocks 10*x* and 10*y* increases by ⅛ inch each time. As illustrated by FIGS. 6A to 6E, for a block 10 having a given depth, $d_L$, for setback lips 40*a*/40*b*, the setback distance, $d_S$, can be adjusted from vertical (FIG. 6A) to the depth, $d_L$, of setback lips 40*a*/40*b* by adjusting the depth, $d_N$, of notch 60 from the depth, $d_L$, to zero (i.e., no notch, which is represented by the example block 10 of FIGS. 4A-4F).

Figures 6F, 7A, 7B, 7C:
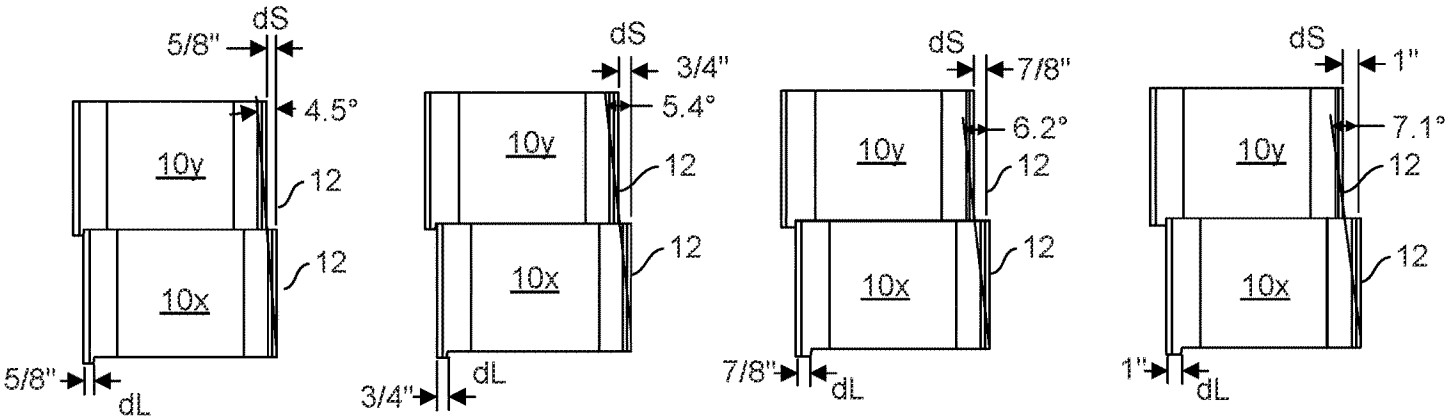
FIGS. 7A to 7C generally illustrate cross-sectional views of example wall structures employing blocks illustrated by FIGS. 4A to 4G, according to one example.

FIGS. 7A-7C are cross-sectional views through a pair of stacked blocks 10*x* and 10*y*, according to the example of FIGS. 4A-4F. In each of the examples, 7A to 7C, without a notch 60, the depth, dL, of setback lips 40*a*/40*b* determines the setback distance, dS, between the front faces 12 of blocks 10*x* and 10*y*. Although specific dimensions are illustrated in FIGS. 6A-6E and 7A-7C for the depth, $d_L$, of setback lips 40*a*/40*b*, and for the depth, $d_N$, of notch 60, it is noted that any number of dimensions different from those illustrated in FIGS. 6A-6E and 7A-7C may be employed.

Figure 8A:
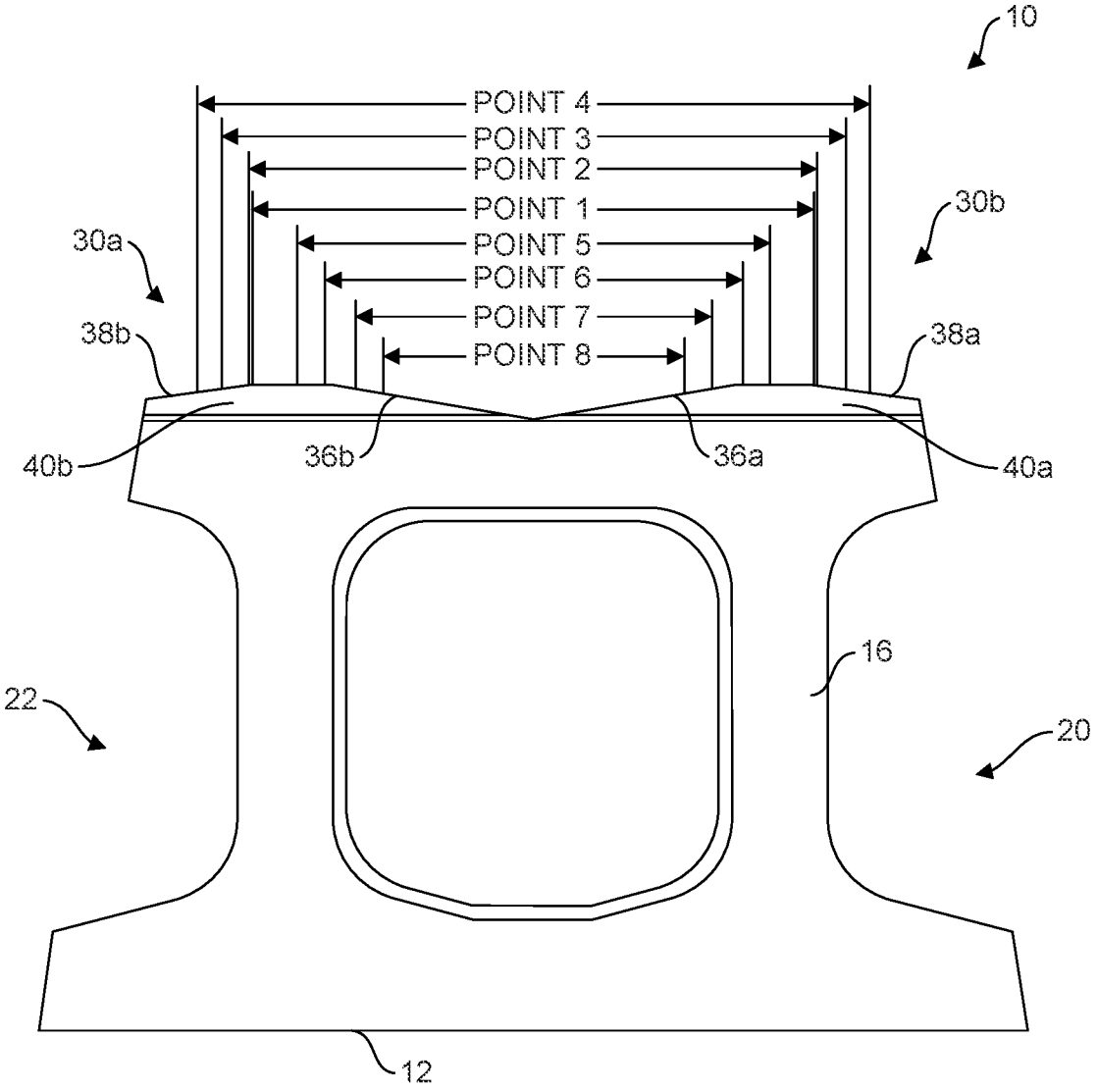
FIGS. 8A to 8I generally illustrate a method of determining control points for modeling a fitted spline curve for use as a curved engagement surface, according to one example of the present disclosure.

FIGS. 8A-8I illustrate an example of a process for determining control points for modeling a fitted spline curve to serve as curved engagement surfaces 30*a* and 30*b*, such as employed by the example implementation of retaining wall block 10 of FIGS. 1A-1G (and as illustrated by the example convex and concave wall structures of FIGS. 2A-2C). FIG. 8A is a bottom side view of block 10 as illustrated by FIGS. 1A-1G, where control points 1-4 are determined to model the respective outer portions 38*a* and 38*b* of the fitted spline curve of curved engagement surfaces 30*a* and 30*b*, and control points 5-8 are determined to model the respective inner portions 36*a* and 36*b* of the fitted spline curve of curved engagement surfaces 30*a* and 30*b*.

As will be described below, a set of blocks, such as blocks 10*a*-10*f* of FIGS. 2B-2D, are stacked in courses to form a wall structure, with blocks 10*a*-10*c* representing a bottom course of blocks, blocks 10*d* and 10*e* representing a middle course of blocks, and 10*f* representing the top course of blocks. The blocks are modeled to form a series of concave wall structures and a series of convex wall structures, wherein the wall structures of each series have an increasing angle of curvature. In one example, as illustrated below, FIGS. 8B-8E represent a series of concave wall structures respectively having 2-degree, 5-degree, 7.5 degree, and 10-degree angles of curvature, while FIGS. 8F-8I represent a series of convex wall structures respectively having 2-degree, 5-degree, 7.5 degree, and 10-degree angles of curvature. In each case, the blocks 10*a*-10*f* are positioned in a running bond configuration modeled so as to have the desired setback distance, $d_S$, between the front faces 12 of each successive course of blocks 10. In the illustrated example, the setback lips 40*a* and 40*b* of each block 10*a*-10*f* has a depth, $d_L$, of ⅝-inch (0.625 inches) such that the desired setback distance, $d_S$, is also ⅝-inch (0.625 inches).

Each of the blocks are initially modeled with a planar rear face 14, and include a line parallel to the rear face 14 representing the planar front surface 42*a*/42*b* of the setback lips 40*a*/40*b*. For each concave and convex wall structure, beginning with the 2-degree angle of curvature, the intersection point (each representing a control point) is determined between the line representing the planar front surface 42*a*/42*b* of the setback lips 40*a*/40*b* of block 10*f* and the rear faces 14 of the underlying blocks 10*d* and 10*e*. Any regions of the rear faces 14 of underlying blocks 10*d* and 10*d* that extend beyond the line representing the planar front surface 42*a*/42*b* of the setback lips 40*a*/40*b* of overlying block 10*f* represents a region of material 70 of the rear faces 14 of underlying blocks 10*d* and 10*d* that must be removed to allow overlying block 10*f* to be positioned with the desired setback distance, $d_S$.

Figure 8B:
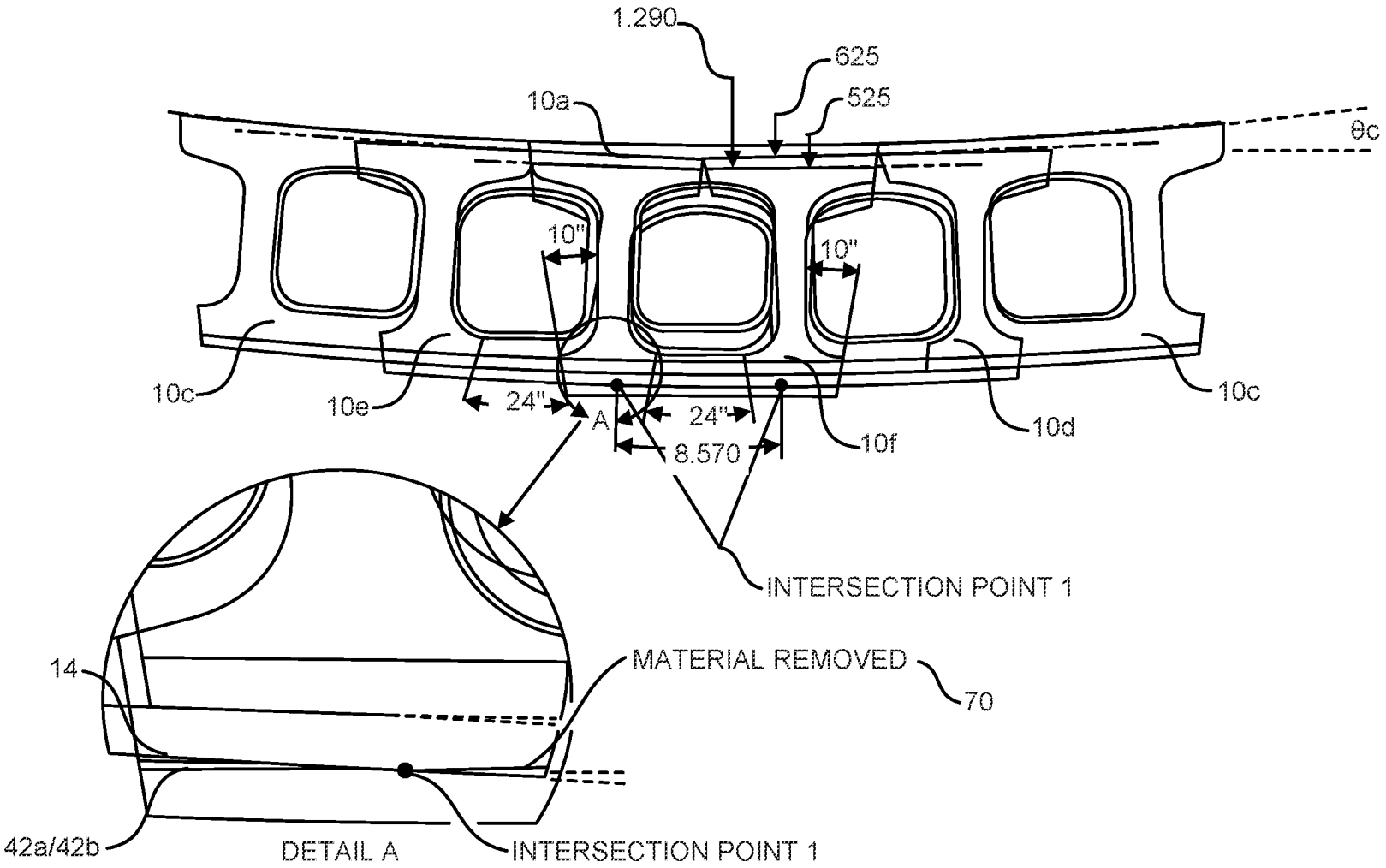

FIG. 8B illustrates modeling the location of intersection point 1 (i.e., control point 1) in a concave wall structure having a 2-degree angle of curvature ($\theta_C$). In the illustrated example, detail A illustrates more clearly intersection point 1 between rear side 14 of underlying block 10*e* and overlying block 10*f*, with the region of rear side 14 extending beyond the line representing the planar front surface 42*a*/42*b* of setback lips 40*a*/40*b* of block 10*f* being indicated, at 70, as material of rear face 14 of underlying block 10*e* which must be removed.

Figure 8C:
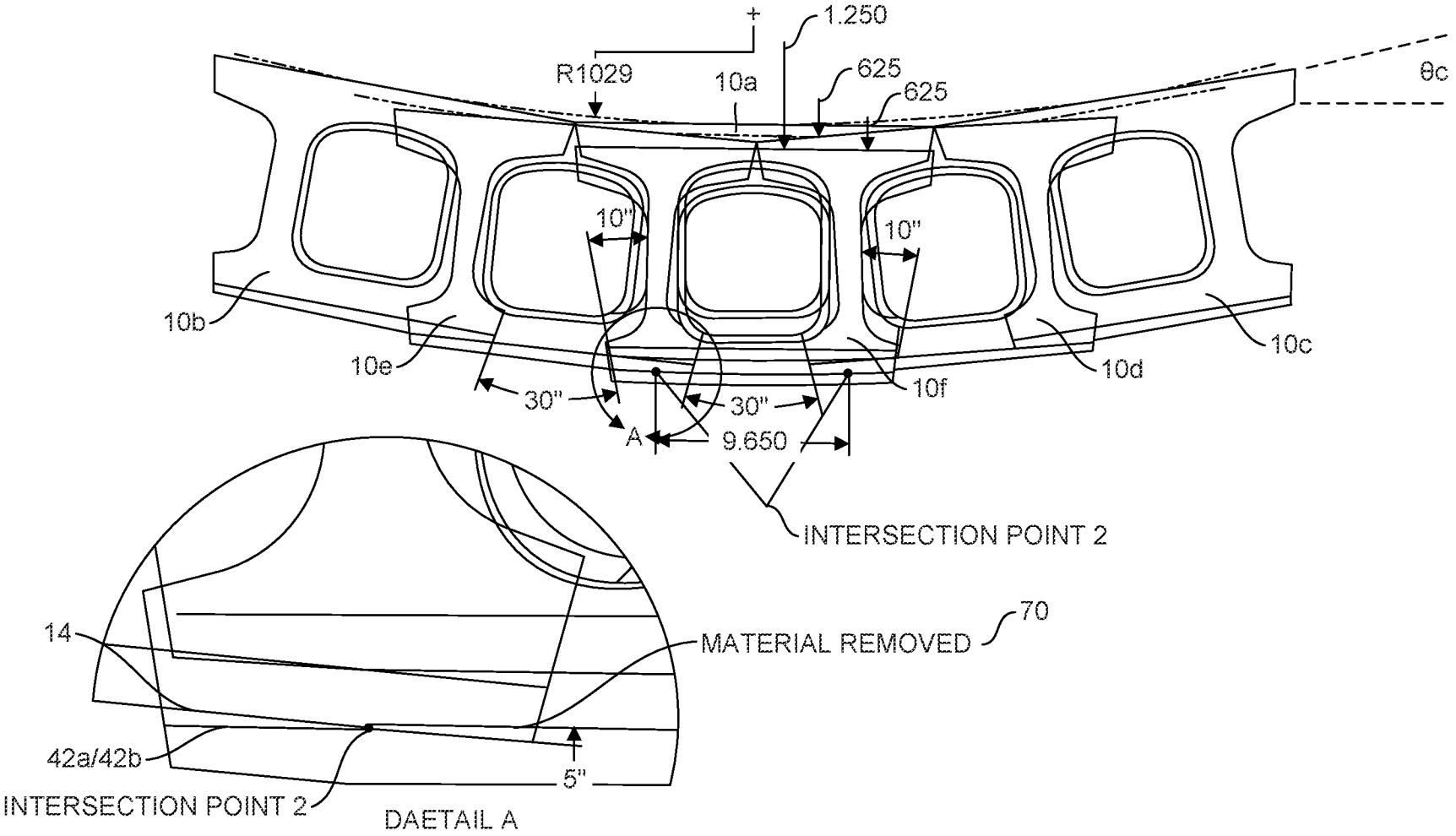
Figure 8D:
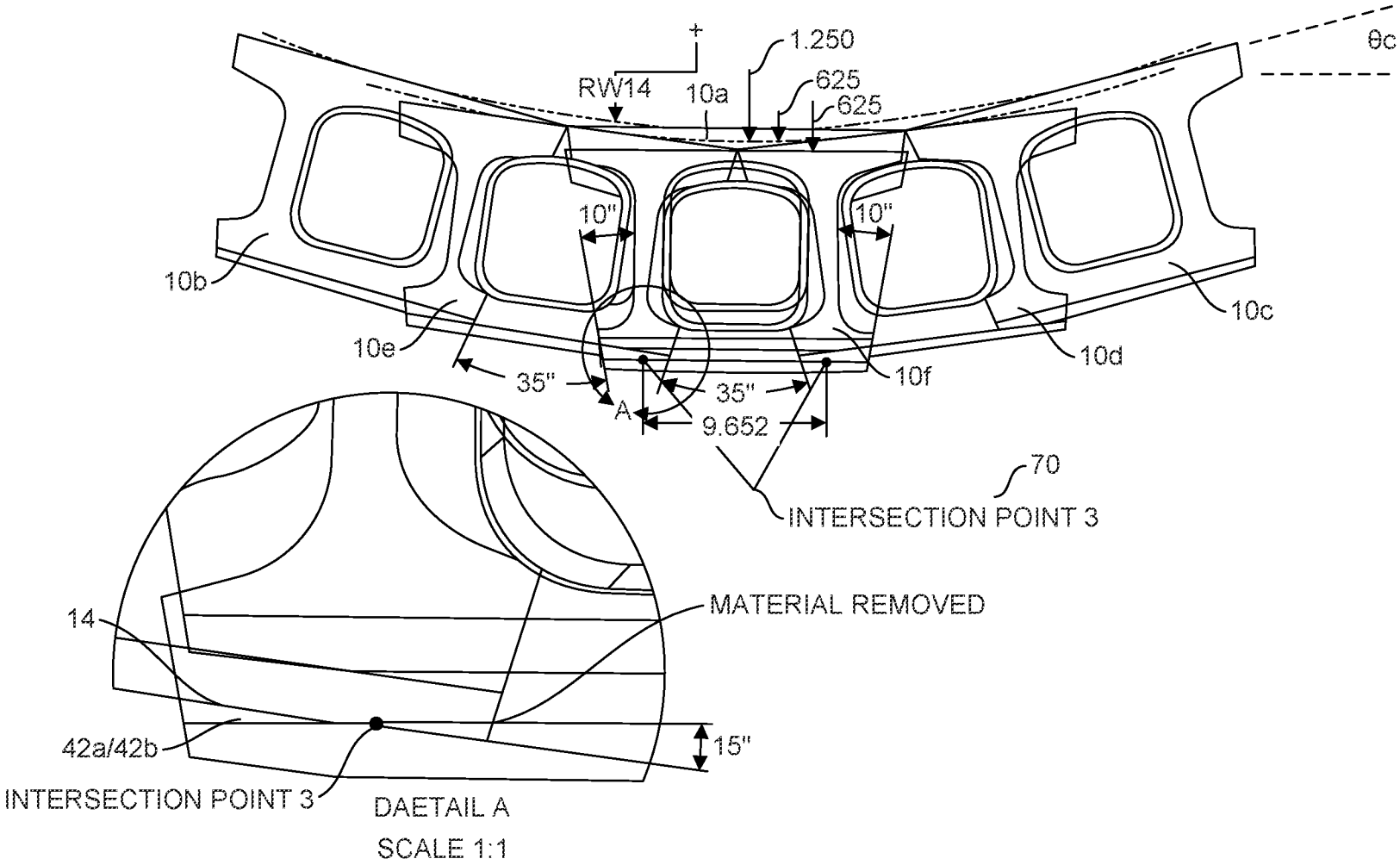
Figure 8E:
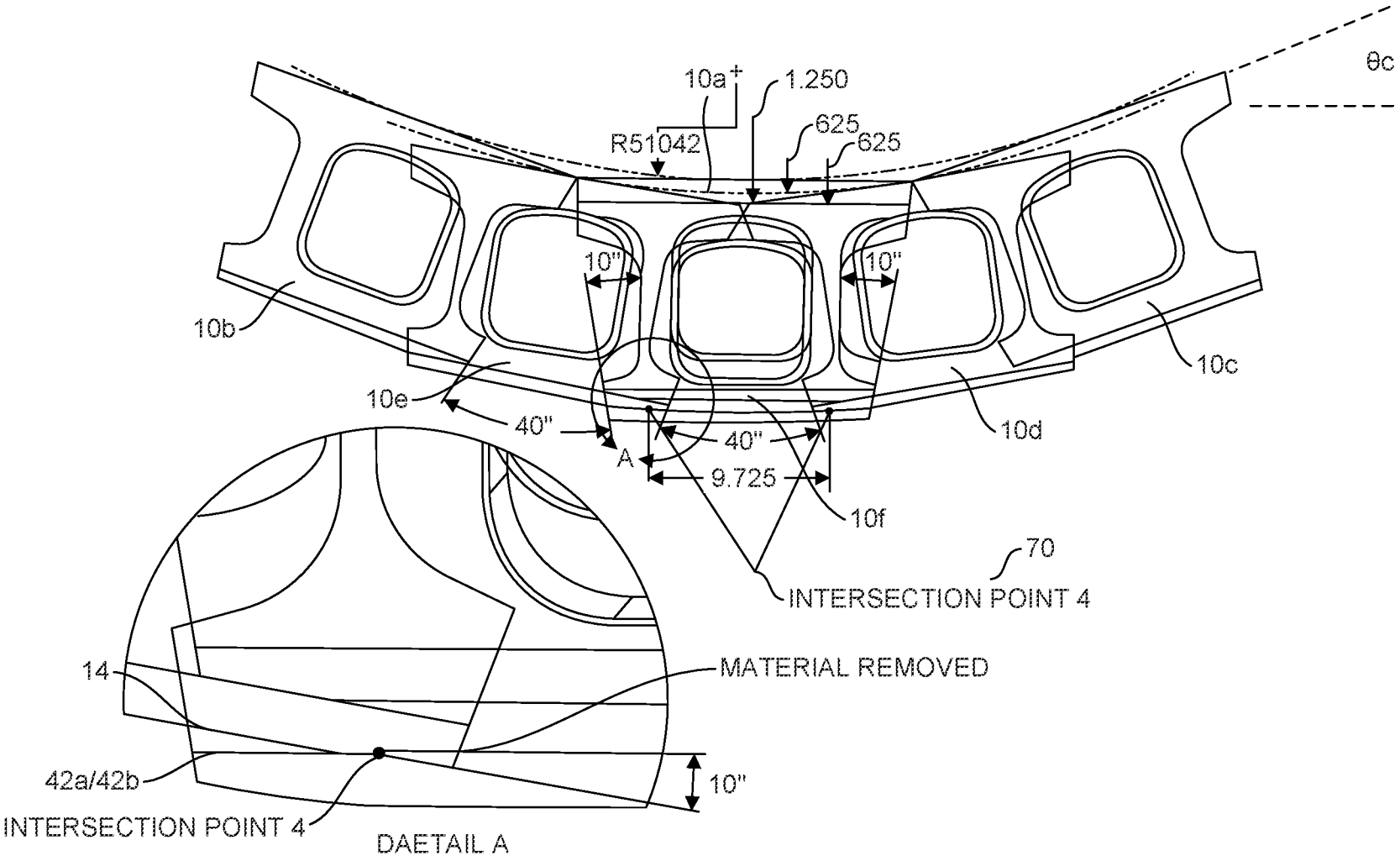
Figure 8F:
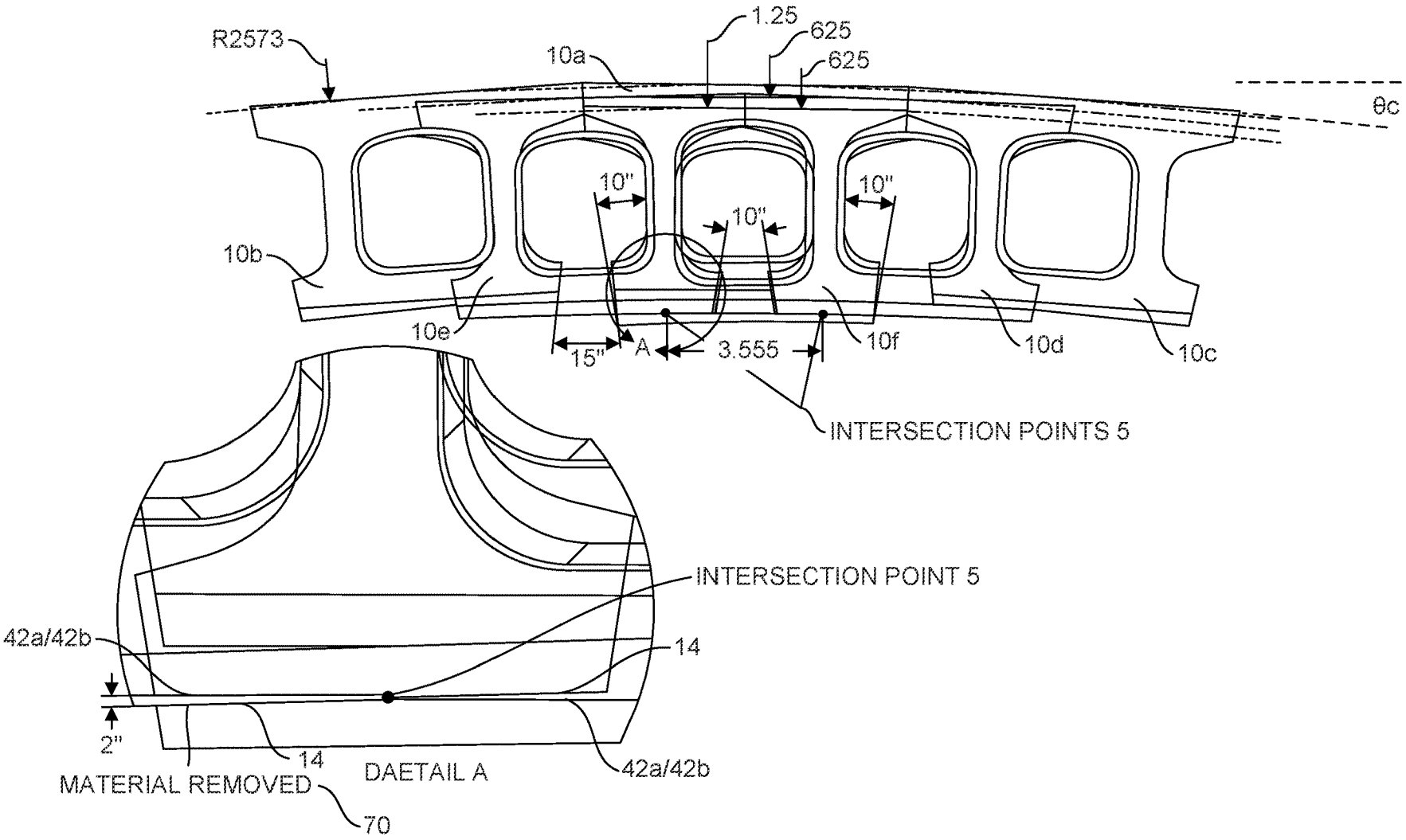
Figure 8G:
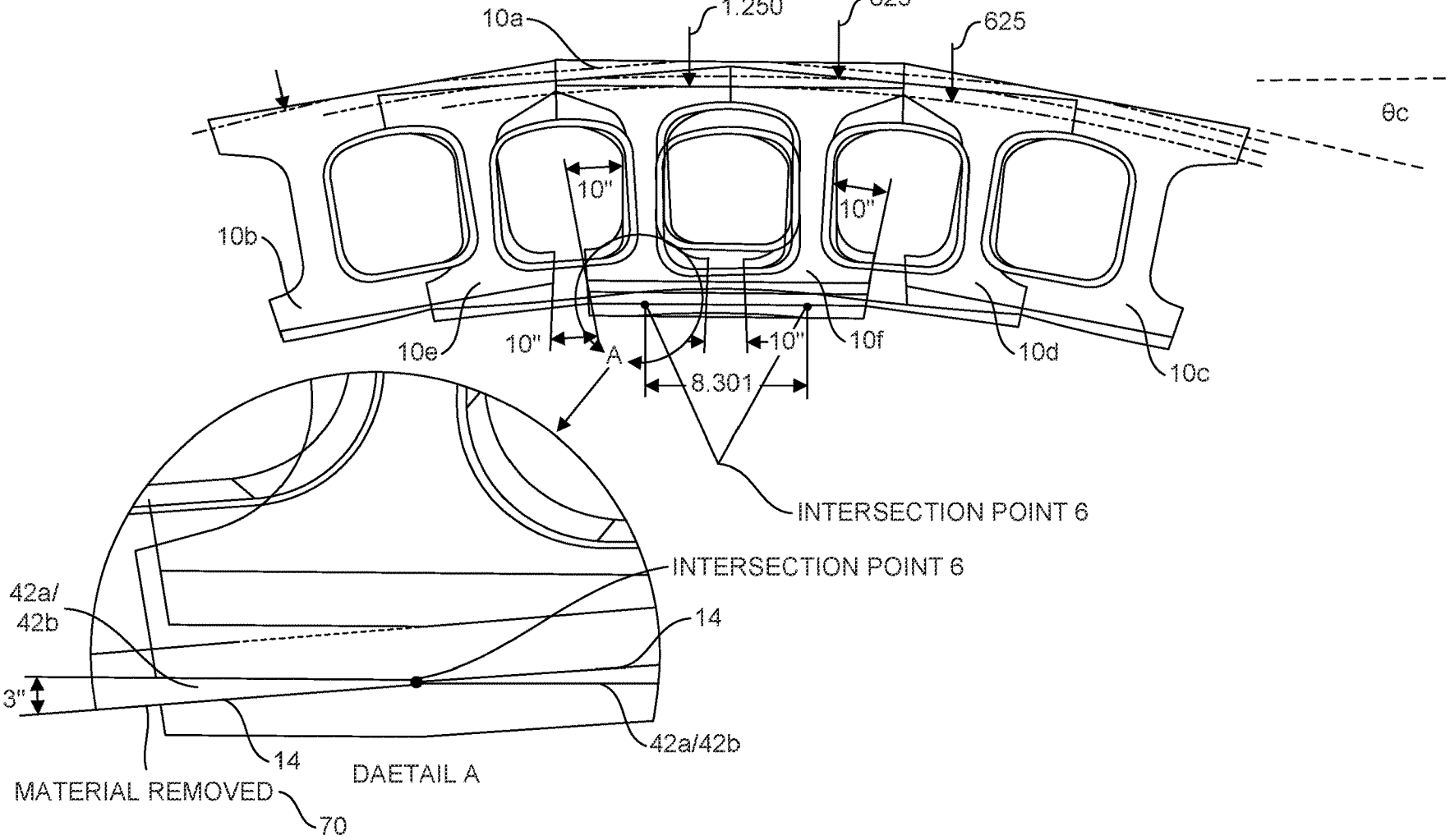
Figure 8H:
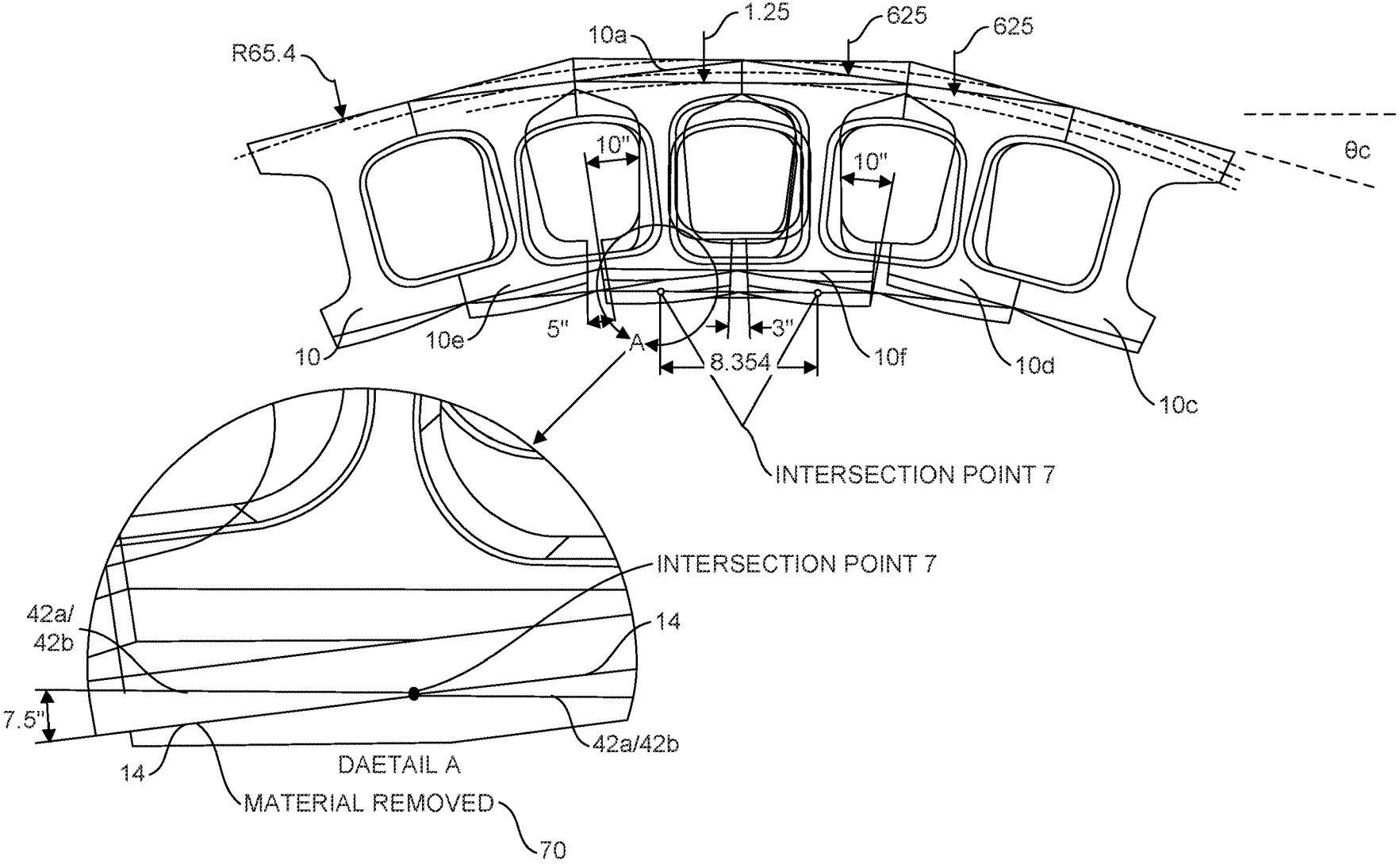
Figure 8I:
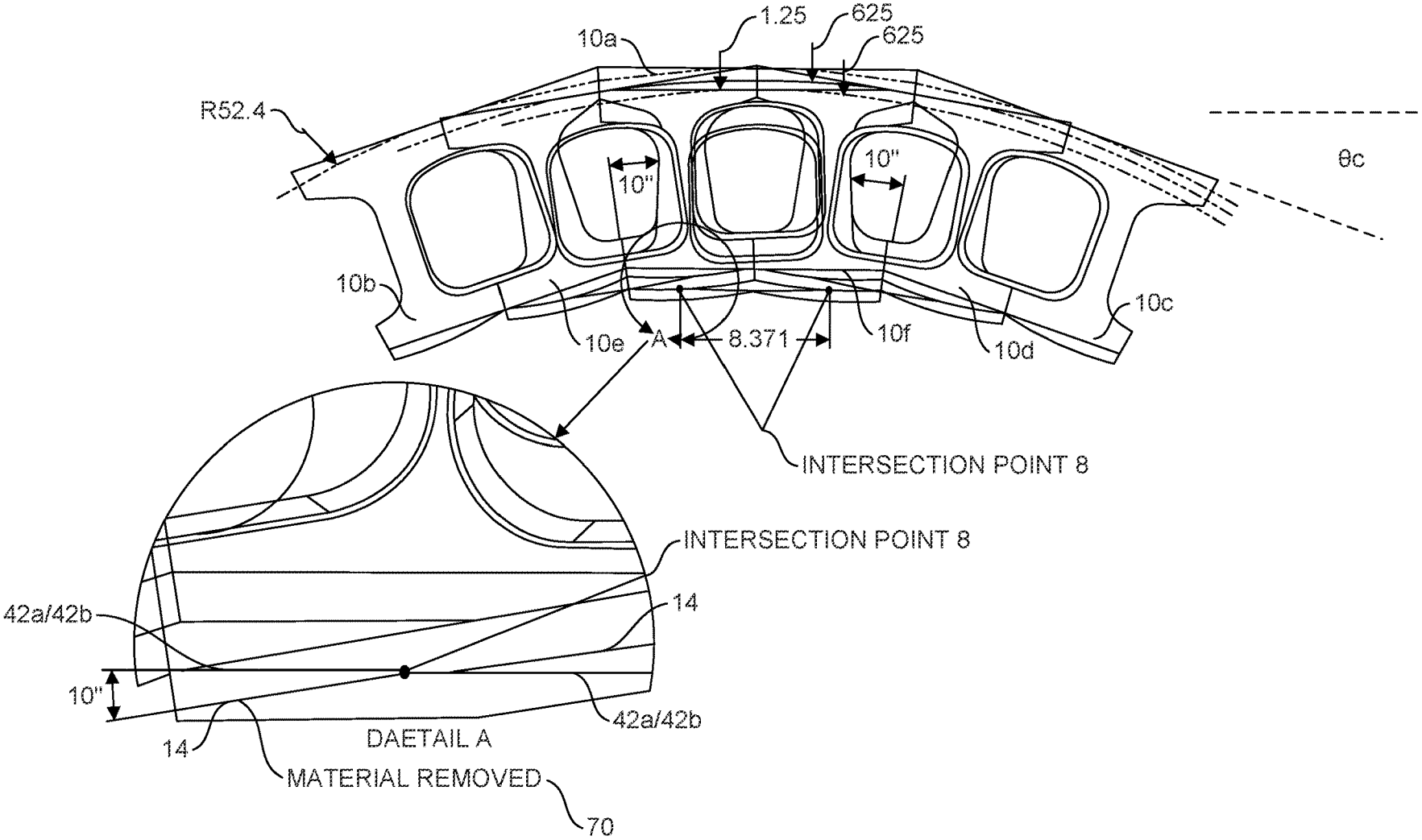

This process is repeated for the concave wall structures having 5-degree, 7.5 degree, and 10-degree angles of curvature ($\theta_C$) to respectively determine control points 2-4, as respectively illustrated by FIGS. 8C-8E. The above described process is similarly carried out for the convex wall structures having 2-degree, 5-degree, 7.5 degree, and 10-degree angles of curvature ($\theta_C$) to respectively determine control points 5-8, as respectively illustrated by FIGS. 8F-8I. Control points 1-8 are then used as control points to which a spline curve is fitted to form curved engagement surfaces 30*a* and 30*b*, such as illustrated by FIG. 8A, and the example retaining wall block 10 of FIGS. 1A-1G.

While the above example describes modeling concave and convex walls having four different angles of curvature angles of curvature ($\theta_C$) to determine 8 control points, in other examples, more or fewer angle of curvature may be modeled so as to determine more than or fewer than 8 control points. It is further noted that other suitable methods may be employed to determine control points for modeling fitted spline curves, in accordance with the present disclosure.

Additionally, it is noted that the teachings herein are suitable for any number of blocks sizes and not intended to limited to the blocks having any particular dimensions.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A retaining wall block comprising:

a top face and an opposing bottom face;

a first side face and an opposing second side face extending between the top face and the bottom face;

a front face and an opposing rear face extending between the top and bottom face and between the first and second side faces, the rear face comprising:

first and second arcuate engagement surfaces which are symmetrical to one another about a transverse centerline of the block extending between the front and rear faces, wherein for each arcuate engagement surface a depth of the block as measured from the front surface to the back surface increases along a first portion of the arcuate engagement surface in a direction from the transverse centerline to an apex of the arcuate engagement surface, wherein the first arcuate engagement surface is disposed between the transverse centerline and the first side face and the second engagement surface is disposed between the transverse centerline and the second side face; and a lip extending from the bottom surface and having planar a front surface which is in parallel with and facing the front surface of the retaining wall block, the lip having a thickness between the front surface of the lip and the back surface of the block defining a setback distance of the retaining wall block, when stacked in a number of successive block courses which are laterally offset from one another in a running bond pattern to form a wall having a convex surface formed by front surfaces of the stacked blocks, a portion of the front surface of the lip proximate to the first side of the block to engage the first portion of the second arcuate engagement surface of a first underlying block and a portion of the front surface of the lip proximate the second side of the block to engage the first portion of the first arcuate engagement surface of a second underlying block adjacent to the second side face of the first underlying block, the first portions of the first and second arcuate segments having a slope which changes from the apex toward the transverse centerline such that a setback distance between front faces of successive courses of blocks is maintained at the defined setback distance along the convex surface of the wall.

2. The retaining wall block of claim 1, wherein the first and second arcuate surfaces each comprise an arc having a same radius of curvature, wherein a centerpoint of the radius of curvature of the first arcuate surface is at a first quarterpoint along the front face as measured from the first side face, and a centerpoint of the radius of curvature of the second arcuate surface is at a second quarterpoint along the front face as measured from the second side face, wherein the radius of curvature of the first and second arcuate surfaces, when perpendicular to the front face, defines a depth of the retaining wall block.

3. The retaining wall block of claim 1, wherein the first and second arcuate surfaces each comprise a fitted spline curve extending between a series of control points, where each control point corresponds to a different angle of curvature of a wall structure to be formed by stacking a plurality of retaining wall blocks in successive courses.

4. The retaining wall block of claim 3, wherein control points between an apex of each of the first and second arcuate surfaces and the transverse centerline correspond to a convex curved wall structure, and control points between the apex of each of the first and second arcuate surfaces and the corresponding side face correspond to a concave curved wall structure.

5. A retaining wall block comprising:

a top face and an opposing bottom face;

a first side face and an opposing second side face extending between the top face and the bottom face;

a front face and an opposing rear face extending between the top and bottom face and between the first and second side faces, the rear face comprising:

first and second arcuate engagement surfaces which are symmetrical to one another about a transverse centerline of the block extending between the front and rear faces, wherein for each arcuate engagement surface a depth of the block as measured from the front surface to the back surface increases along a first portion of the arcuate engagement surface in a direction from the transverse centerline to an apex of the arcuate engagement surface, wherein the first arcuate engagement surface is disposed between the transverse centerline and the first side face and the second engagement surface is disposed between the transverse centerline and the second side face, wherein:

the first and second arcuate surfaces each comprise an arc having a same radius of curvature, wherein a centerpoint of the radius of curvature of the first arcuate surface is at a first quarterpoint along the front face as measured from the first side face, and a centerpoint of the radius of curvature of the second arcuate surface is at a second quarterpoint along the front face as measured from the second side face, wherein the radius of curvature of the first and second arcuate surfaces, when perpendicular to the front face, defines a depth of the retaining wall block; and a lip extending from the bottom surface and having planar a front surface which is in parallel with and facing the front surface of the retaining wall block, and a rear surface comprising the first and second arcuate surfaces.

* * * * *